US005746347A

United States Patent [19]

Riedemann et al.

[11] Patent Number: 5,746,347

[45] Date of Patent: May 5, 1998

[54] METHOD AND APPARATUS FOR DISPENSING PARTICLES FROM A CONTAINER

[75] Inventors: Thomas P. Riedemann, Moembris, Germany; Richard F. Cavagnaro, Sparta, N.J.; Klaus W. Rolf, Linsengericht-Geislitz, Germany; Hans-Juergen Strempel, Hainburg, Germany; Guenther Michael, Karlstein, Germany; Gerd T. Brand, Ronneburg, Germany; Andreas Ernst, Maintal, Germany; Roland Schaffer, Linsengericht-Eidengesass, Germany; Herbert Riemenschneider, Gelnhausen-Meerholz, Germany

[73] Assignee: Degussa Aktiengesellschaft, Frankfurt, Germany

[21] Appl. No.: 697,857

[22] Filed: Sep. 3, 1996

Related U.S. Application Data

[60] Provisional application No. 60/003,589 Sep. 12, 1995.

[51] Int. Cl.[6] ..... B67B 7/00; B65G 69/06; B05D 7/00

[52] U.S. Cl. ..... 222/1; 222/195

[58] Field of Search ..... 222/181.2, 181.3, 222/185.1, 195, 406, 630, 637, 1

[56] References Cited

U.S. PATENT DOCUMENTS 2,301,617 11/1942 Cox et al. .
2,861,604 11/1958 Whitmire .

(List continued on next page.)

FOREIGN PATENT DOCUMENTS 0033832 1/1981 European Pat. Off. .
628481 12/1994 European Pat. Off. .

(List continued on next page.)

OTHER PUBLICATIONS

Database WPI—Week 9037—Derwent Public. Ltd. AN 90–280562 (anonymous 'handling of microspheres for dust free emptying of bags').

*Primary Examiner*—Andres Kashnikow
*Assistant Examiner*—Keats Quinalty
*Attorney, Agent, or Firm*—Beveridge, Degrandi, Weilacher & Young, LLP

[57] ABSTRACT

An apparatus and method for dispensing fine particle material from a container such as a flexible intermediate bulk container. The invention includes a dispensing assembly that has a dispensing device that is secured to an outlet tube of the container. Securement is achieved by a strap member wrapped about the container's outlet tube and a clamping casing and/or by an inflatable member that expands outward from the clamping casing. The casing surrounds a transport tube which is axially shiftable following securement of the clamping casing to the outlet tube. A head piece with gas cavity and radial and oblique extending ports is provided at the end of the transport tube. The dispensing device is inserted into the outlet tube below a blocking member provided at the base of the outlet tube. Following attachment of the outlet tube to the clamping casing, the blocking member is released. The transport tube is then released from a first position, shifted and then fixed in a second position. The second position places the head of the dispensing device into the main compartment of the container and above the released blocking member. At this location gas, is injected through the ports and product is drawn out through the interior of the transport tube. In an alternate embodiment, there is used, either alone or in combination with the headpiece, an injection branch for directing a jet of air down the central axis of the transport tube. In another embodiment, a constricted member having a venturi configuration is provided in the same area within the transport tube as the outlet of the injection branch.

42 Claims, 15 Drawing Sheets

U.S. PATENT DOCUMENTS

| | | | |
|---|---|---|---|
| 3,097,677 | 7/1963 | Mitchell | 150/1 |
| 3,118,474 | 1/1964 | Eppolito . | |
| 3,214,221 | 10/1965 | Finnegan . | |
| 3,886,983 | 6/1975 | Forssen et al. . | |
| 3,994,532 | 11/1976 | Hahn . | |
| 4,018,253 | 4/1977 | Kaufman . | |
| 4,149,755 | 4/1979 | Handleman et al. . | |
| 4,182,386 | 1/1980 | Alack . | |
| 4,445,809 | 5/1984 | Schmitz et al. . | |
| 4,457,456 | 7/1984 | Derby et al. . | |
| 4,527,716 | 7/1985 | Haas et al. | 222/181.3 |
| 4,550,755 | 11/1985 | Vredenburg, Sr. . | |
| 4,574,851 | 3/1986 | Lepisto . | |
| 4,790,708 | 12/1988 | Von Bennigsen-Mackiewicz et al. | 414/413 |
| 4,833,008 | 5/1989 | Derby . | |
| 4,966,311 | 10/1990 | Taylor | 222/181.3 |
| 5,018,877 | 5/1991 | Kantz . | |
| 5,248,429 | 9/1993 | Larsen . | |
| 5,271,695 | 12/1993 | Bischof et al. . | |
| 5,341,959 | 8/1994 | Ellis | 222/185.1 |
| 5,458,264 | 10/1995 | Schaffer et al. . | |
| 5,474,111 | 12/1995 | Williamson et al. | 141/1 |

FOREIGN PATENT DOCUMENTS

| | | |
|---|---|---|
| 8528561 | 1/1986 | Germany . |
| 4011698 | 9/1991 | Germany . |
| 4021674 | 1/1992 | Germany . |
| 9217248 | 4/1993 | Germany . |
| 2056932 | 3/1981 | United Kingdom . |
| 94/20396 | 9/1994 | WIPO . |
| WO 95/11178 | 4/1995 | WIPO . |

METHOD AND APPARATUS FOR DISPENSING PARTICLES FROM A CONTAINER

CROSS-REFERENCE TO COPENDING APPLICATIONS

This application is a continuation-in-part of copending provisional application Ser. No. 60/003,589 filed on Sep. 12, 1995, which application is incorporated by reference in its entirety.

Reference is also made to disclosure document #380081 filed in the U.S. PTO on Jul. 21, 1995.

FIELD OF THE INVENTION

The present invention features a method and apparatus for the removal of fine material from containers. The invention is particularly suited for emptying fine, cohesive, powdery bulk material such as pyrogenic (fumed) silicas, precipitated silicas and silicates, powder blacks, etc. from flexible intermediate bulk containers (FIBC), also called big bags, supersacks and the like.

BACKGROUND OF THE INVENTION

The handling of fine, cohesive, powdery bulk material (i.e. fine material) has proven to be particularly troublesome in those industries which handle such material. One particular problem in fine material handling is the providing of a system that is essentially dust-free so as to maintain a safe working environment while also providing a relatively inexpensive handling system that can quickly empty containers containing such material. In addition, any time there is a dust problem in the working environment, there is also an increased chance of contamination of other products. The amount of dust which is produced in the working environment is often related to the manner in which the fine material is received, stored and distributed by the intended users. Some recipients of fine material rely on silos or storage rooms which are capable of handling large volumes of material. With such storage facilities, bulk delivery is typically the most economical and often features road or railborn silo vehicles with pneumatic pumps that can pump the material from the silo vehicle directly to the storage facility. Hence, this system is very effective in maintaining a relatively dust-free working environment. However, not all facilities have the necessary equipment or storage space for receipt of a bulk delivery while other facilities do not use a sufficient volume of the fine particle material to warrant the expense of a bulk delivery receiving system.

For lower volume users of fine particles or for recipients which have little storage space, delivery of the fine particles by way of paper or plastic sacks stacked on pallets is often preferred. However, the potential for dust creation is high when dealing with individual bags as the opening and disposal of each bag has a tendency to release dust into the environment. While there are automated assemblies for opening, emptying and discarding bags, this equipment is very expensive and thus often not economically plausible for many recipients.

Many customers or recipients prefer semi or intermediate bulk delivery as it avoids the high labor requirements associated with handling a plurality of individual paper sacks or because they have use for an amount of particle material which falls between the extremes of bulk delivery and paper sack delivery. In an effort to satisfy the requirements of these intermediate users, various semi-bulk containers have been introduced. For example, a container-formed of reinforced lined fabric has been utilized. This flexible container is known as a flexible intermediate bulk container (FIBC) or often also referred to in the industry as a "big bag" or "supersack". A single bigbag is normally stored on a pallet and transported by a floor conveyor, particularly fork-lift trucks. Bigbags with a volume of about 100 liters to 3,000 liters, usually 1,500 to 2,000 liters, comprise one or more layers of a wide variety of materials, particularly fabrics of synthetic or natural fibers or tapes and sheets; frequently an inner liner of sheet material, e.g. polyolefin, is combined with an outer bag made of tape fabric. In the upper region, the bigbags have a closable filling opening, which can also be used for ventilation during emptying. The bigbags also normally have a number of carrying loops for use with hoists. At the bottom there is usually a bag outlet which is tightened and tied or sewn together with one or more cords or held in position with a clip.

When bigbags are emptied, they are supported by hoists over the container to be filled. The outlet is opened, e.g. by releasing the closing cords, and the bag empties in an uncontrolled manner. As noted, the FIBC is suspended and typically discharged by the opening provided at the end of an integral nozzle forming part of the flexible container into an inner port of a further processing or delivering system. The base of the integrated outlet nozzle is provided with the pinching draw cord seal which is released at the desired discharge time. Many conventional emptying techniques place the outlet of the nozzle just above a grate or screen or the like representing an upstream opening of a suction source. The grate or screen is surrounded by a flanged partial enclosure with heavy reliance being placed on the suction from the suction source to avoid the spread of material into the environment which is often not completely effective in this regard.

The use of a flexible intermediate bulk container thus can present some problems with respect to escape of dust particles during the release of the product to the downstream processing or delivering system. In addition, before the empty bag can be discarded, it has to be folded to a size which may be easily handled. The folding and handling of the large bag can lead to a large generation of dust in the environment, especially in light of the fact that the particles often stick to the side of the container due to the static charges which develop during emptying and also because the particles become trapped within various nooks and crannies in the bag.

This combination of sticking particles, trapped particles and the inability of conventional dispensing devices to adequately reach the retained particles presents an additional problem in the industry of loss of product. This loss of product can lead to a significant increase in the cost of operation when taking into consideration the relative expense of typical fine material being dispensed, the increased reliance being placed on these products by industry, and the resultant large quantities of product being processed.

Furthermore, the requirement for a dust-free working environment is mandated in many countries by way of regulations which fix the maximum dust concentration that can exist in the work environment. The maximum dust concentration value is determined, in part, on the perceived health risk associated with a particular fine particle material. These regulations typically set a limit value on the weight of fine particle material per given volume of air or upon the number of particles per given volume of air. For example, although synthetic amorphous silicas have not been found to be harmful to the lungs to date, these substances are included in the list of materials which have been assigned a maximum concentration value at the work place. In the Federal Republic of Germany, for example, the maximum synthetic silica concentration is set at 4 mg/m$^3$. It is thus imperative that the fine material handling and disposal processes be of a type which avoids the introduction of dust into the environment.

SUMMARY OF THE INVENTION

The present invention is directed at providing a fast and easy handling system which minimizes dust release to the environment when FIBC's are being emptied of their fine material. Some of the advantages of the present invention are listed below:

The invention makes possible a rapid emptying of fine powdery/dust-like bulk material from FIBCs which material would otherwise not run out on account of its intrinsic flow behavior or at least would not run out through a discharge piece with customary diameter.

The invention allows for emptying to be achieved through a discharge outlet with a customary size or even a still smaller diameter size, which assures an excellent freedom from dust.

The discharge device with integrated discharge aid (the fluidization device) can be fixed in position with respect to a closed FIBC and then be brought, after the opening of the bottom discharge outlet of the FIBC, to its place of operation while the entire system is closed to the outside.

The invention can easily be managed by a single person.

The invention can be used as an individual device or also integrated in FIBC emptying stations automated to a greater or lesser extent.

No damage is caused to the FIBCs by using the invention, making it possible to reuse the FIBCs.

These and other advantages are made possible by the design of the present invention which features a dispensing assembly for dispensing fine particles from a container. The dispensing assembly includes a dispensing device that has a transport tube with a product inlet opening at a forward region and a product discharge opening at a rearward region. The dispensing device also includes a head piece positioned at the forward region of the transport tube, with the head piece having a chamber housing defining a gas receipt chamber, and a plurality of gas outlet ports formed in the chamber housing. The chamber housing preferably combines with a radially inwardly positioned segment of the transport tube to provide a gas tight enclosure (except for the gas outlet ports and gas infeed opening).

A gas feed conduit is in communication with the gas receipt chamber via the gas infeed opening formed in the head piece. In addition, a clamping casing, which extends circumferentially about the tube, is in contact with the transport tube such that the transport tube is axially adjustable between a first position and a second position once the clamping casing is axially fixed in position with respect to an outer tube of the FIBC. As the outer tube is typically formed of a flexible material, the operator can grasp the FIBC's outlet tube and clamping casing with one hand while the other hand shifts the transport tube's position. Alternately, a support member of the like can be used to help maintain the outlet tube and clamping casing fixed in position while the transport tube is shifted (e.g. part of an automated process). The transport tube can move freely between a first and second position with respect to the clamping casing (or vice versa). The transport tube moves between a front and a rear stop on the transport tube with the stops making contact with the clamping casing. The first position places the clamping casing closer to the head piece than the second position. The dispensing device also includes a fixing device or means for fixing which is adapted to fix a portion of the container to said clamping casing prior to said transport tube being shifted from the first position to said second position.

The invention features an axial fixing assembly for axial fixing the transport tube and clamping casing in a desired relative axial position and which is releasable or designed to allow for axial shifting of the transport tube with respect to the clamping casing to a different position. The fixing assembly can take a variety of forms such as a threaded engagement wherein the friction between the threads fixes the transport tube and clamping casing in a desired position until relative rotation (and axial adjustment), one or more wing screws (thumb screws) or the like which frictionally contact the exterior surface of the transport tube when threaded inwardly (or an intermediate member positioned therebetween), a sliding key or bearing member received within a corresponding riding groove with two radially extending axial locking recesses, etc. In a preferred embodiment of the invention a metal belt of spring steel or the like is received within a circumferential recess formed in a rear region of the clamping casing. One or more threaded bore holes open into the circumferential recesses such that a wing screw or the like received by a corresponding bore hole forces the belt into frictional contact with the exterior surface of the transport tube when the screw's end is threaded inwardly. The pinching of the belt by the wing screw as well as the pinching and locking of the transport tube by the pinched belt is terminated when the wing screw is retracted.

The invention also preferably includes at least one sealing member provided between the clamping casing and exterior of the transport tube to help avoid the release of dust between any gaps formed between the two components. In a preferred embodiment a plastic or elastomeric seal member is received within a stepped, circumferential groove formed in the forward region of the clamping casing. The clamping casing includes an inwardly extending flange forward of the stepped groove to retain the sealing member in position. The sealing member also has an inwardly sloped forward end which extends out away from the forward end of the casing. This sloped forward end contacts and rides along the exterior surface of the transport tube. Preferably, a second sealing member, similar to the above-noted sealing member, is provided at a rearward end of the clamping casing which includes a retaining flange at its rearward most end.

The head piece of the dispensing device includes a chamber housing which extends completely about the circumference of the tube and includes an axial wall portion and an oblique wall portion, and the chamber housing includes a plurality of radial ports in the axial wall portion that are spaced circumferentially about the head piece and a plurality of oblique ports in the oblique wall portion that are also spaced about the circumference of the head piece and preferably longitudinally aligned with the radial ports.

The gas feed conduit of the dispensing device extends along an interior surface of the transport tube and opens into the gas receipt chamber. The gas feed conduit opens into the transport tube at a position axially rearward of the casing when the transport tube is at the second position and opens into the gas receipt chamber axially forward of the casing when the transport tube is at the first position so as not to interfere with the clamping casing as the transport tube is axially adjusted between the first and second positions. Also, the gas feed conduit has a forward end which briefly extends radially and opens into the chamber housing in a rearward half region position between a forward wall and a rearward wall that define a forward end and a rearward end of the gas receiving chamber.

The clamping casing includes a rearward section and a forward section with the forward section having a circumferential recess formed therein. The dispensing device further comprises an inflatable member received within the circumferential recess formed in the forward section of the clamping casing.

Radially extending walls of the circumferential recess help retain the inflatable member in position within the recess. Optionally, the forward section can also include a forward flange section extending rearwardly so as to partially cover the circumferential recess and a rearward flange section extending forwardly so as to also partially cover the circumferential recess while leaving an open area between the forward end rearward flanges through which the inflatable member extends upon inflation. In this particular embodiment, the inflatable member is nestled within the circumferential recess radially inward of the flanges whereby retention of the inflatable member upon inflation is further facilitated.

The dispensing device further comprises an infeed pipe for the inflatable member which is supported by the rearward section of the clamping casing and provides for the introduction of pressurized gas into the inflatable member. Upon gas introduction, the inflatable member is radially expanded out away from the clamping casing and into contact with the flexible outlet nozzle of the container. The inflatable member retains its axial position both when in an inflated state and when in a non-inflated state as it is nestled within the recess. This retention is further assured with the use of the axially extending flanges limiting the axial length of the recess, although for most uses of the dispensing devices the circumferential recess alone is sufficient. Additional securement is also possible by adhering a portion of the inflatable member to the clamping casing.

The transport tube of the dispensing device has a common interior diameter along its axial length and the product inlet opening is formed at a forwardmost end of the transport tube and has a same diameter as the common interior diameter. The head piece has a forward end essentially commensurate with the product inlet opening in the transport tube.

The dispensing assembly further includes a fixing device that is preferably a strap or band like member which fixes the container portion against the clamping casing. The rearward section of the clamping casing supports the fixing device and the forward section of the clamping casing supports the inflatable member, with the fixing device being positioned externally with respect to the outlet tube or nozzle of the container. The inflatable member is positioned within the outlet tube when the outlet tube is fixed to the rearward section of the clamping casing by the fixing device.

The present invention further comprises a transport line and a transport unit. The transport line has an upstream end communicating with an outlet opening at the rearward end of the transport tube of the dispensing assembly and a downstream end in communication with the transport unit. The transport unit includes a suction generating device for drawing product through the transport tube and the transport line. The dispensing assembly further comprises a pressurized gas unit for introducing pressurized gas into the gas receiving chamber via the gas infeed pipe which travels internally within the transport tube between an introduction location and an exit location.

The dispensing assembly can also include, as part of its overall assembly, a fine particle container having an outlet tube, with the fixing device fixing the outlet tube to the clamping casing. The dispensing device and FIBC can either be an integral unit or two components releasably fixed to one another.

The flexible intermediate bulk container used with the present invention preferably has a volume of 1.5 $m^3$ to 2.5 $m^3$. Also the outlet tube has a diameter which is within 3 cm of an exterior diameter of the clamping casing with the exterior diameter of the clamping casing preferably ranging from 6 to 35 cm and more preferably 6 to 15 cm.

The present invention also features a method for dispensing fine particles from a container with an outlet tube. This method comprises inserting a dispensing device into the outlet tube (unless it is already an integral portion thereof) and fixing a clamping casing of the dispensing device to the container's outlet tube. The clamping casing extends about a transport tube of the dispensing device and, after the clamping casing is fixed to the FIBC's outlet tube, the transport tube (with respect to the clamping casing) is shifted between a first position and a second position whereby a head section of the dispensing device is further removed from an outlet end of the outlet tube in the second position than in the first position. Gas is introduced from the head section of the dispensing device into the container via a plurality of ports. This gas flow can be initiated at any time following the fixing of the FIBC's outlet tube to the clamping casing and after inflation of the inflatable member if an inflatable member is utilized. In one embodiment of the invention, injecting gas through the ports is delayed until the head section is placed in the second position.

While the product is being subjected to the pressurized gas, it is also drawn from the container through an opening in the dispensing device and out of an exit in the dispensing device. Thus, the transport unit is operated simultaneously with the gas injection (or shortly after gas injection while the product is still in a flotation state).

The method further preferably includes fixing the dispensing device to the outlet tube by inflating the inflatable member supported by the clamping casing into contact with the outlet tube. Alternatively, fixing the dispensing device to the outlet tube includes both applying a fixing device such as a band or strap like member so as to pinch the outlet tube between the band or strap like member and the clamping casing and inflating an inflatable member supported by the clamping casing forward of the band or strap like member such that the inflatable member contacts an interior surface of the outlet tube. As yet another alternative, reliance is placed on the fixing device alone and an inflatable member is not utilized.

In a preferred embodiment, the method also includes, subsequent to insertion of the dispensing device and the affixing of the dispensing device to the outlet tube and prior to the shifting of the tube between the first and second positions, releasing or removing a member which is preventing product from exiting the main compartment of the container and entering the outlet tube such that product is released into the outlet tube. After the product is released, the transport tube is then shifted to the second position. The initiating of the drawing of product through the dispensing device follows release of the member and can be applied together with the initiation of the pressurized gas injection (or shortly prior to or shortly after the introduction of the pressurized gas). Thus, the initiating of suction can occur either at the first position or at the second position or sometime there between.

The method of the invention also includes, at a point close to a complete emptying of the container, a shifting of the transport tube back to the first position while gas is being ejected from the head section and product is being drawn through the transport tube. This allows for the discharge of material that normally may have become stuck due to static charges or due to being trapped in a bag fold or crevice.

In an alternate embodiment, the means for introducing gas into the container to facilitate particle dispensing includes a hook-shaped branch conduit which directs a jet of air down the central axis of the transport tube away from the opening toward the outlet of the transport tube. The hook shaped conduit branch can either be used alone or in combination with the multi-port headpiece described above. Also, the hook-shaped conduit branch can be used in conjunction with a venturi shaped constricting insert secured to the interior of the transport tube.

DETAILED DESCRIPTION OF THE PREFERRED EMBODIMENTS

Figure 1A:
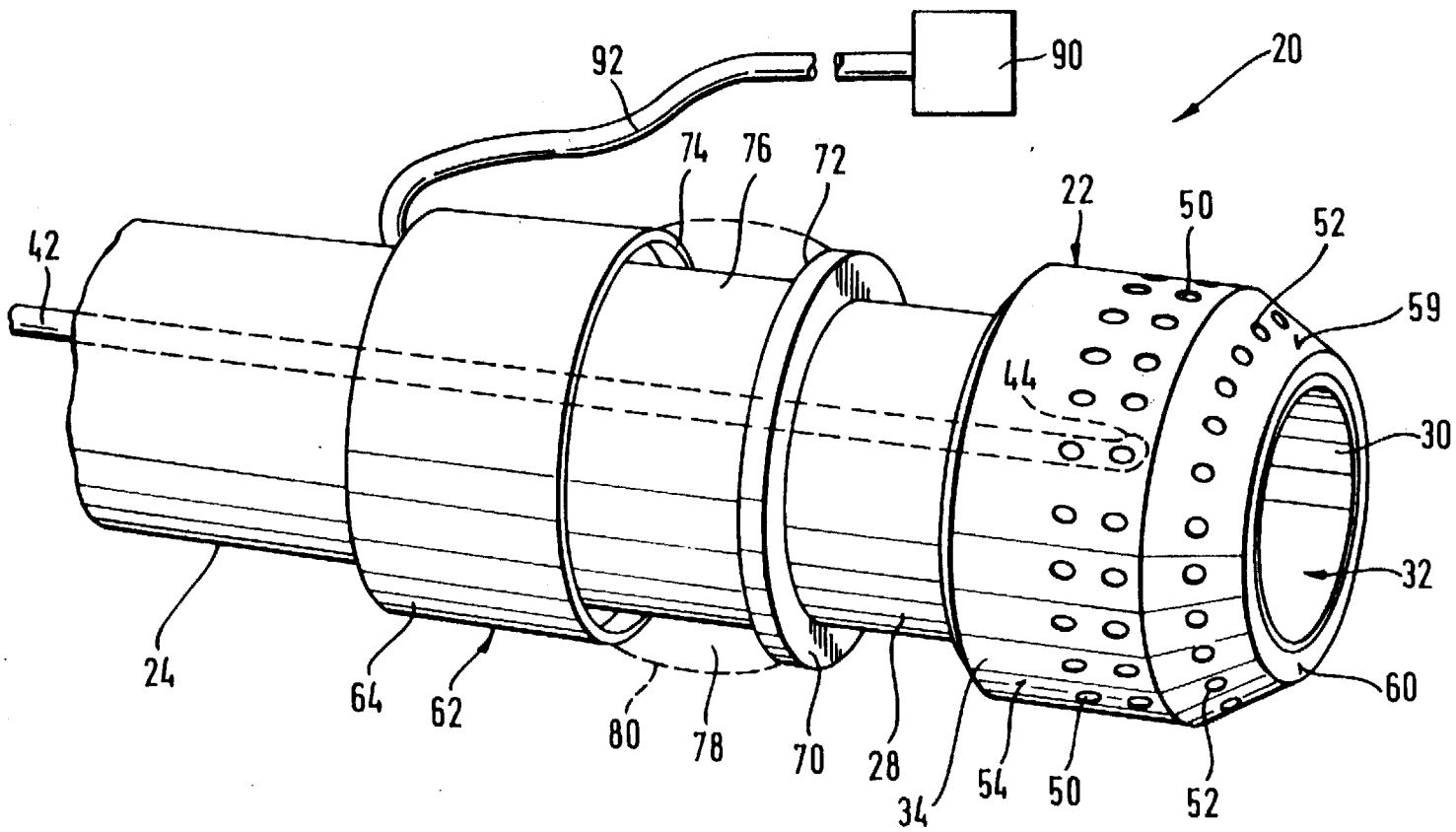
FIG. 1A shows a cut away, perspective view of a front portion of one embodiment of the present invention's dispensing device together with a pressurized gas introduction assembly.
Figure 1B:
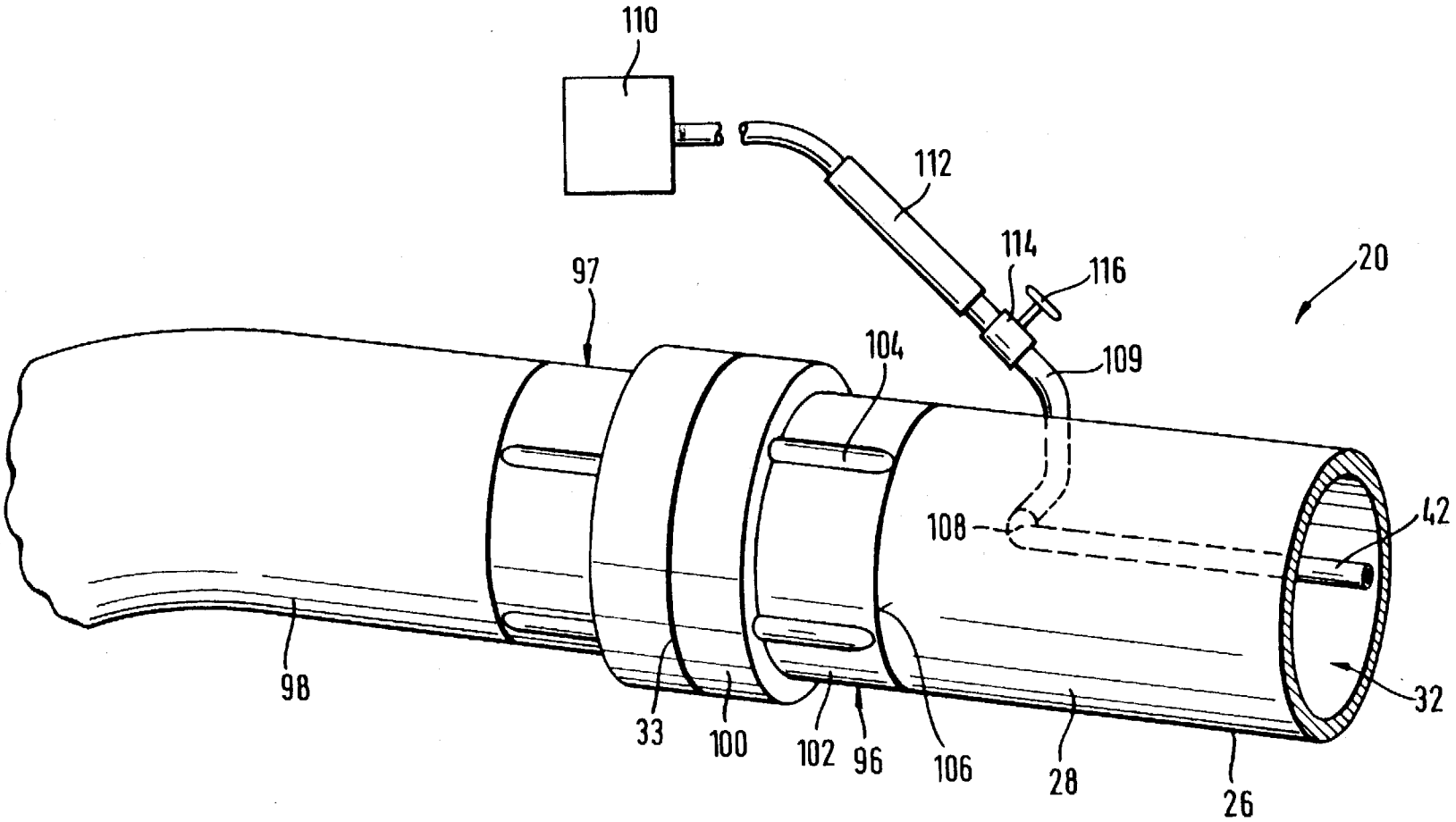
FIG. 1B shows the remaining rear portion of the dispensing device partially shown in FIG. 1A.

FIGS. 1A and 1B together illustrate, in cut-away fashion, dispensing assembly 20. FIGS. 1A and 1B show front and rear sections (24,26) of dispensing device 22 which forms a component of dispensing assembly 20. FIG. 1A shows front section 24 of dispensing device 22 as including a front portion of transport tube 28. The front portion of transport tube 28 has internal conduit 32 which opens out at open front end 30. Internal conduit 32 extends essentially uninterrupted from open front end 30 to an open rear end defined by circular rear edge 33 (FIG. 1B). Tube 28 is preferably formed of an Al Mg 3 alloy for lightness and strength and is of a length of about 40 to 80 cm with a diameter of about 60 to 150 mm. As discussed in greater detail below, however, the tube's length and diameter are variable with the goal being to provide a dispensing device easily handled by a single operator, sized for a close fit with an outlet conduit of a container and which can achieve the desired degree of container dispensing within a given time period.

Figure 2:
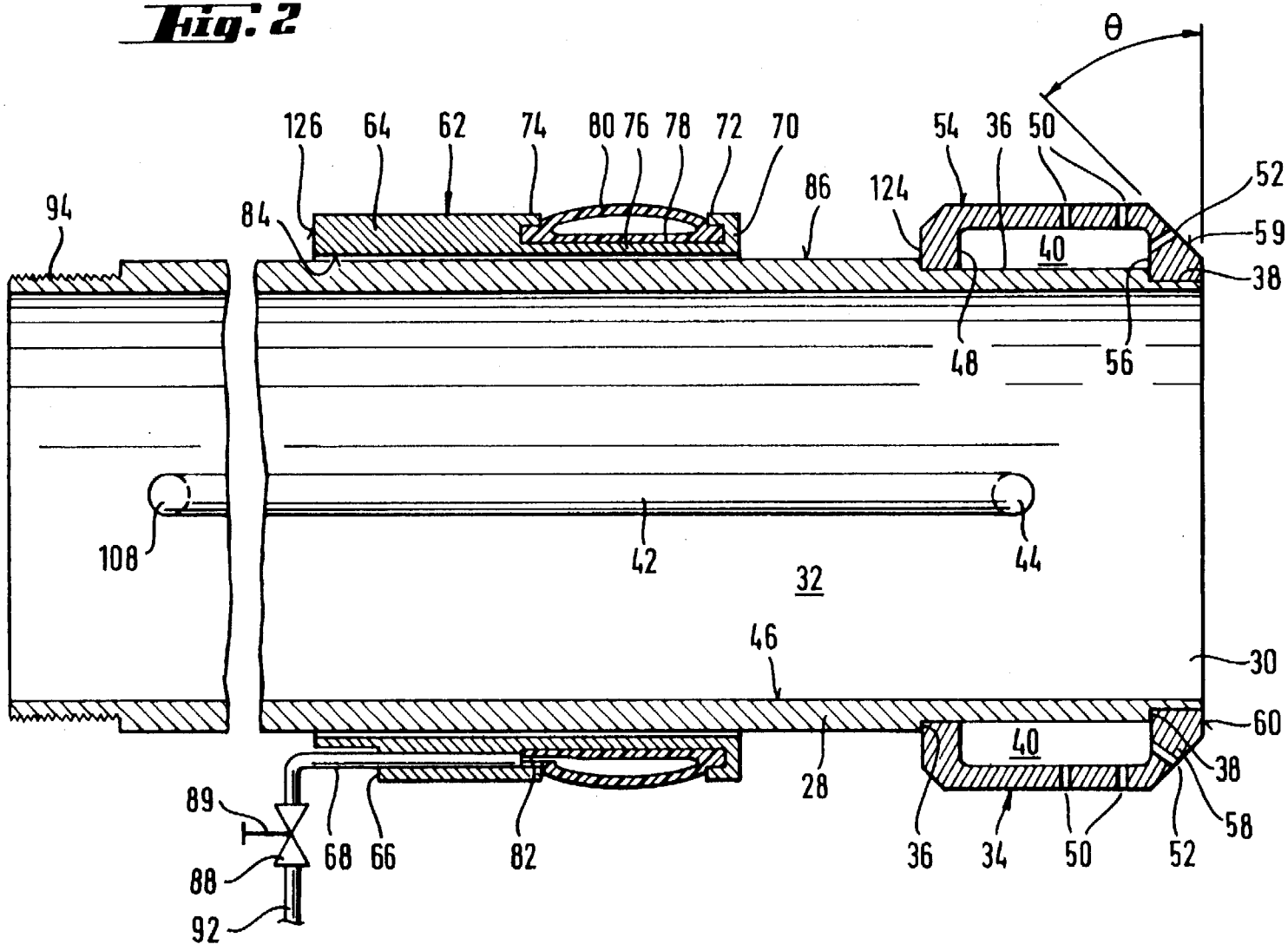
FIG. 2 shows a cut-away longitudinal cross-sectional view of the portion of the dispensing device shown in FIG. 1A.

Dispensing device 22 further comprises headpiece 34 which is secured to (e.g. welded or threaded) or integral with (e.g., molded as a single unit) the front end of tube 28 and preferably formed of the same material as the tube. With reference to FIGS. 1A,1B and 2 a first embodiment of tube 28 with combined headpiece 34 is illustrated. As illustrated in these figures, and particularly in FIG. 2, tube 28 includes a first stepped shoulder axially extending area 36 and a second stepped shoulder axially extending area 38. Headpiece 34 is secured (e.g. permanently via welds and/or adhesive or the like or releasably via threads or a key lock arrangement either at both shoulder areas or one or the other) to the front end of tube 28.

The combination of headpiece 34 and the underlying portion of tube 28 defines cavity 40. Pressure conduit 42 has forward end 44 which curves into contact with interior surface 46 of tube 28. Conduit 42 opens into cavity 40 preferably at a lower half portion and even more preferably within 10 mm of lower cavity side wall portion 48 defining part of cavity 40. This helps the gas flow pass around the circumference of cavity 40 prior to flowing out through radial ports 50 and oblique ports 52. Alternatively, a plurality of circumferentially spaced conduits or a single conduit with a plurality of manifold like sections which each open into cavity 40 can be relied upon. A single conduit as shown is preferred, however, as additional conduits can create flow interruption locations in the interior of tube 28.

In one embodiment of the invention, radial ports 50 are arranged in longitudinally aligned and spaced pairs which pairs are circumferentially equally spaced (e.g., a 5 to 20 mm circumferential spacing and more preferably a 10 mm spacing) about the circumference of headpiece 34. The longitudinal placement of ports 50 is preferably arranged such that each port is spaced within the upper 50% of cavity wall portion 54 extending between cavity side wall portions 48 and 56. The ports are either equally longitudinally spaced from one another within the upper 50% region or, when two longitudinally spaced ports are utilized, within 5 mm of respective side wall portion 56 and the longitudinal half way point between wall portions 48 and 56. Also, the ports are preferably between 1–5 mm in diameter and more preferably about 2 mm in diameter. The interior of wall portion 54 is preferably radially spaced from stepped area 36 of tube 28 by about 10 to 30 mm with the wall portions being longitudinally spaced by about 25 to 50 mm, there dimensions for head 34 are designed for use with a tube 28 that has an open front end of about 60 to 100 mm.

As shown in FIG. 1A oblique ports 52 are longitudinally aligned with the pairs of ports 50 and are preferably of the same size. In a preferred embodiment 1 to 3 oblique ports are spaced longitudinally along oblique wall section 58 which has an exterior surface 59 that slopes at angle θ which is preferably from 30 to 60 degrees and, more preferably, about 45 degrees from the planar upper surface 60 at the very front of headpiece 34 (or a radial plane at the tube's forward edge if there is no planar surface extension). Oblique ports 52 extend transverse to the oblique exterior surface 59 of wall section 58 and open into cavity 40.

As further shown in FIG. 1A, on the exterior surface of tube 28 there is positioned clamping casing 62. Clamping casing 62 is free to slide or shift longitudinally along tube 28 into a desired position wherein it is locked or retained in position. Various ways of allowing for longitudinal adjustment and retention at a desired position are possible such as a threaded engagement between the exterior of tube 28 and the interior of clamping casing 62 or the use of a thumb screw or screws extending through bore holes in the clamping casing or a preferred embodiment described in detail below with reference to FIG. 8.

FIG. 2 illustrates a cross-sectional view of clamping casing 62. As shown therein, casing 62 features a rear section 64 which represents a solid cylindrical section except for a longitudinal groove 66 formed so as to facilitate insertion of infeed pipe 68. Infeed pipe 68 can either be in fluid communication with a bore formed in rear section 64 or can include a pipe section extending through a correspondingly sized through-hole. Forward section 70 of casing 62 is integral with rear section 64 and optionally features two inwardly extending flange sections (72,74). Forward section 70 also includes thin wall section 76 which, together with the longitudinally spaced end wall of the recess, define ring-shaped recess 78. Within ring-shaped recess 78 is positioned inflatable seal 80. Inflatable seal 80 is in fluid communication with infeed pipe 68 at junction 82 as shown in FIG. 2. Interior surface 84 of casing 62 is sized slightly larger than the exterior surface 86 of tube 28 and a seal member or members can be provided to preclude the passage of fine dust through this gap. A preferred seal arrangement is described in detail below with reference to FIGS. 8A and 8B.

With reference to FIGS. 1A and 2, valve 88 is provided to prevent and to allow for the introduction of pressurized air from pressurized air source 90 (e.g., a pump or pressurized gas cylinder) and through intermediate line 92 extending between valve 88 and source 90. Valve 88 can be a three-way valve or that which provides for the release of pressure and the deflation of inflatable seal 80 at the desired moment. Also, valve 88 can be opened, closed, or placed in a discharge mode via handle 89 extending therefrom.

With reference to FIGS. 1B and 2 there can be seen coupling section 94 provided at the rear end of tube 28 which receives coupling member 96. Coupling member 96 includes cylindrical portion 102 which is threaded or otherwise coupled to coupling section 94 of tube 28 and includes gripping or grasping members 104 as well as connecting head 100 releasably connected to second coupling member 97 positioned at the end of transport line 98. Second coupling member 97 is received by the forward end of transport line 98 through which fine particle material passes during a discharging of the container. As transport line 98 is used to convey fine particle material exiting from tube 28, it is typically formed of a flexible, clear plastic material preferably together with a flexible strengthening plastic spiral frame structure and grounding means (not shown).

Figure 10:
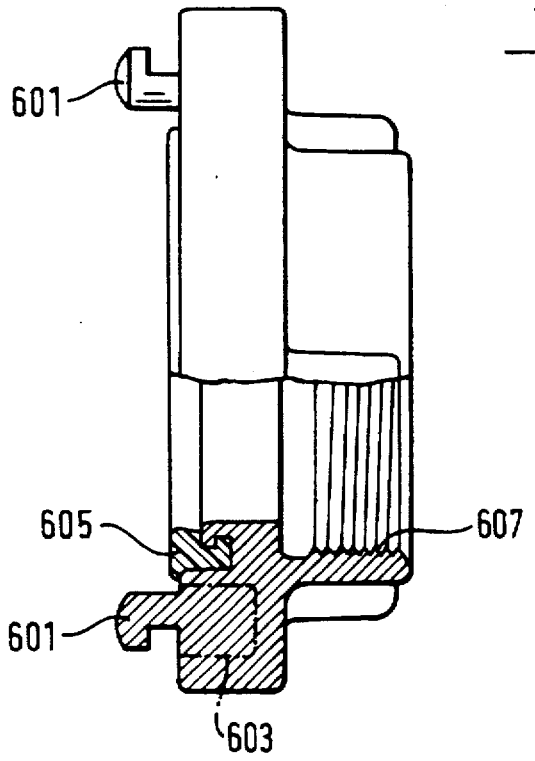
FIG. 10 shows a preferred embodiment of the transport tube rear end coupling.
Figure 11:
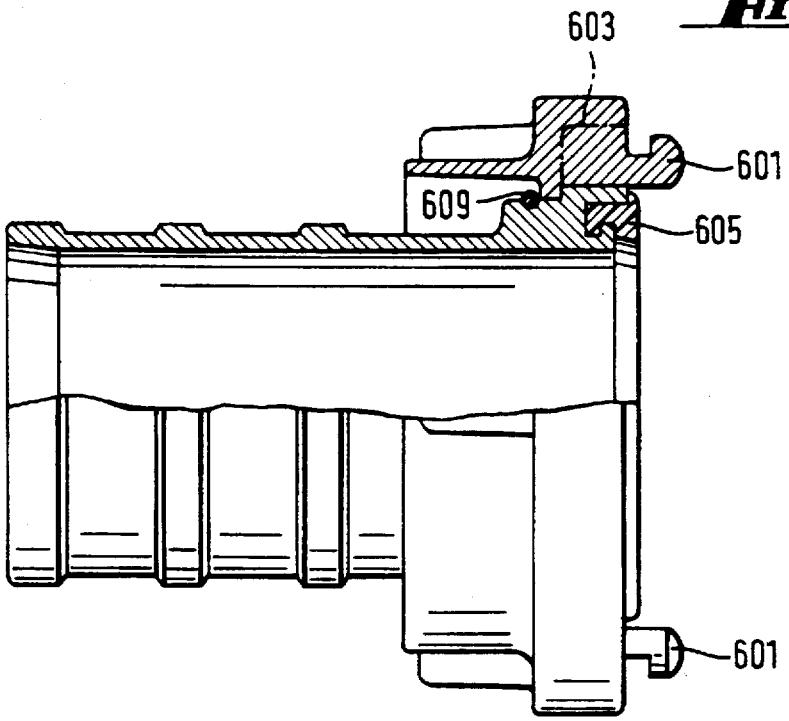
FIG. 11 shows a preferred embodiment of the transport line front end coupling which joins with the coupling of FIG. 10.

Any coupling assembly that provides for uninterrupted flow of fine particles from the transport tube to the transport line, that is suitable for pneumatic conveying and that prevents the escape of fine particle material in the area of the coupling assembly can be relied upon. For example, a threaded arrangement can be utilized. In a preferred embodiment, however, the two coupling members 96, 97 are provided with respective male and female engaging structures (e.g., bayonet couplings) as well as a compression seal. A suitable bayonet type coupling for coupling member 96 includes the standard DIN 14308 coupling for installation on rigid pipes while a suitable coupling member for coupling member 97 includes the standard DIN 14322 for installation on flexible hoses. FIG. 10 shows, in partial cross-section, a standard DIN 14308 coupling while FIG. 11 shows a standard DIN 14322 coupling. As can be seen from these figures each coupling includes a plurality of circumferentially spaced bayonet members 601, a plurality of circumferentially spaced bayonet reception ports 603 extending adjacent the bayonet members (see the dash line representation) and a seal ring 605. The bayonets and reception ports correspond such that the bayonet members of one coupling are releasably received by the reception ports in the other coupling and the seal members make sealing contact. Also, each of the two standard couplings has an attachment (607, 609) for receiving a corresponding one of the rigid tube and flexible hose.

As shown in FIG. 2, pressure conduit 42 includes second end 108 which extends through and opens out to the exterior 86 of tube 28 just longitudinally forward (e.g., 1 to 10 cm) of the forward end 106 of coupling member 96. Conduit 42 is preferably formed of a metallic material with at least one of the first and second ends (44, 108) of conduit 42 preferably being fixed with respect to tube 28 such as by being welded or threaded in position. A rigid or non-rigid extension conduit 109 extends out away from exterior surface 86 of tube 28 for the introduction of a pressurized gas to pressure conduit 42 from pressurized gas source 110. Pressurized gas source 110 can take on a variety of forms although a pump which is suitable for causing gas to flow out of the radial and oblique ports 50 and 52 to achieve fluidization of the particles to be removed is preferred. Preferably air is the gas which is introduced conduit 42 although other types of gases can also be used. To avoid contamination, especially when immediate environmental air is used, source 110 can include a filter suitable for preventing passage of solid contaminants in the air while allowing for air to pass through (e.g., a "Schumacher" type filter) and/or an in line filter 112 can be provided in conduit extension 109 between source 110 and second end 108 of conduit 42. On line 109 is also preferably provided an on/off valve 114 with easily graspable handle 116.

Figure 3:
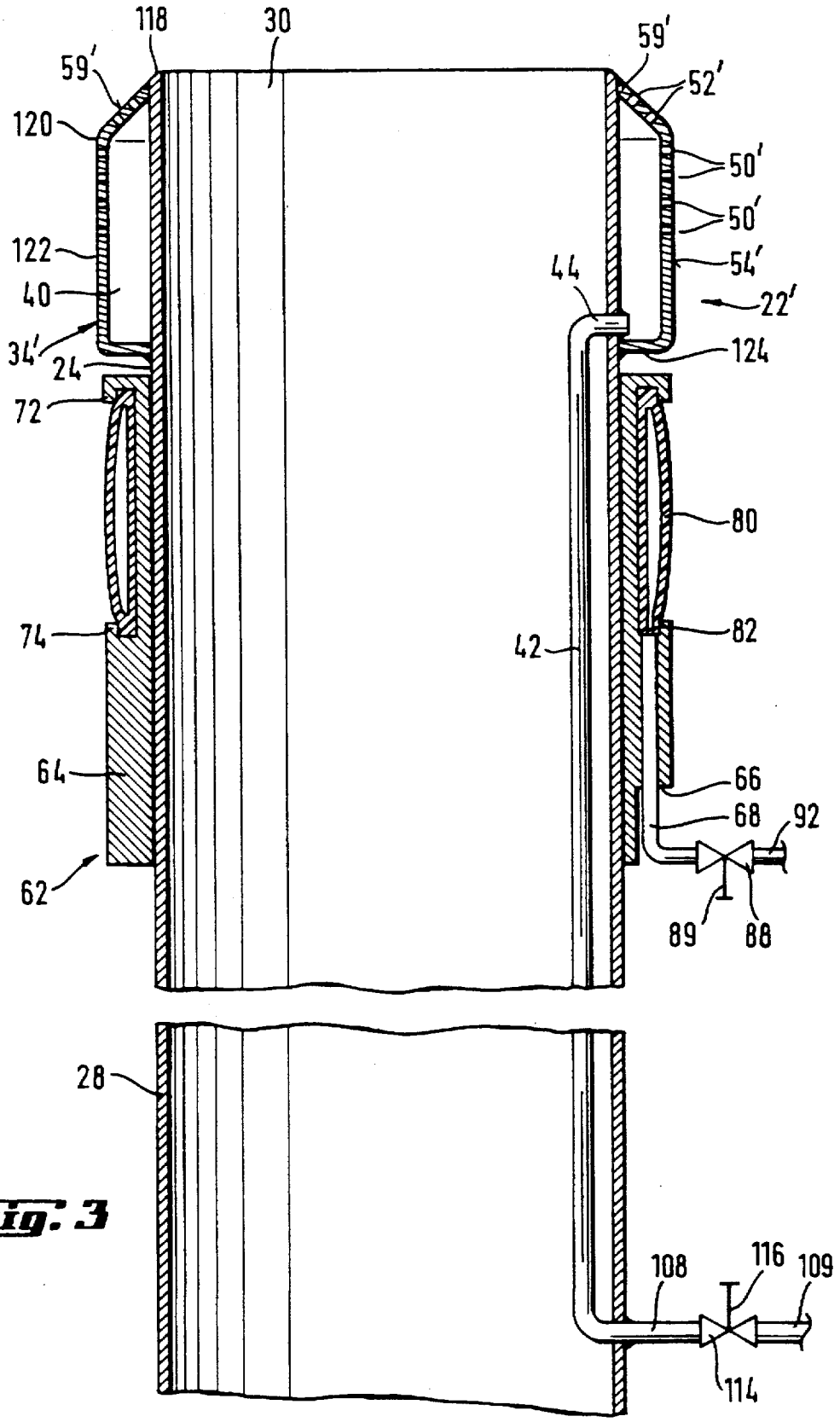
FIG. 3 shows a cut-away, longitudinal cross-sectional view of a second embodiment of the present invention's dispensing device with the transport tube in a first position.
Figure 4:
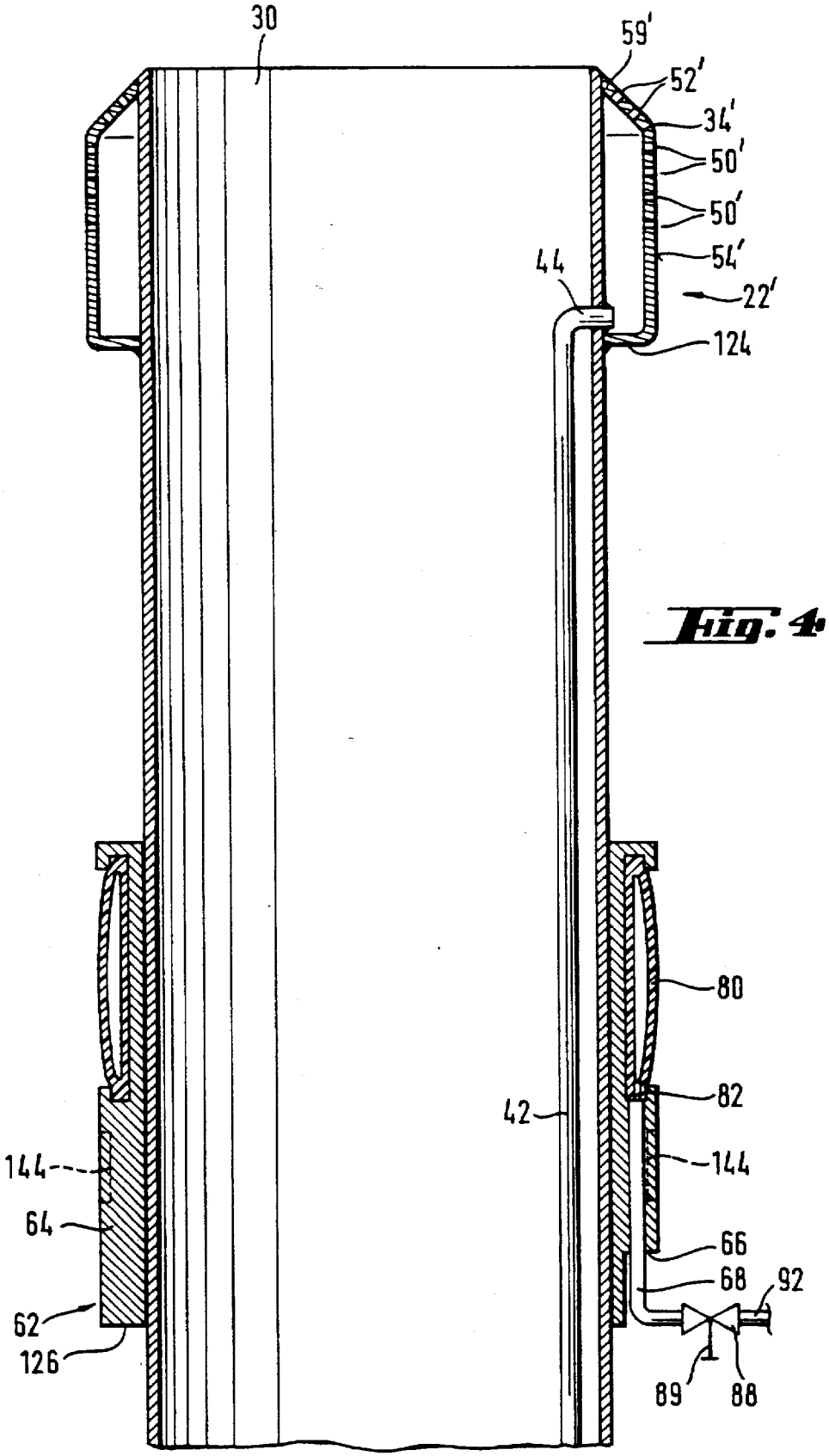
FIG. 4 shows the embodiment of FIG. 3 with the transport tube in a second position.

FIGS. 3 and 4 illustrate an alternate embodiment of dispensing device 22' of the present invention wherein like components are designated with the same reference numbers as in the earlier embodiment. Dispensing device 22' features a modified head piece 34' which is preferably a stamped plate or the like (or part of the original tube itself and bent around the front end 24 of tube 28) and welded or otherwise fixed into position. As can be seen by a comparison between FIGS. 2 and 3, head piece 34' does not include the planar front surface 60 included in the FIG. 2 embodiment as inclined section 59' in FIG. 3 directly intersects the front end tip 118 of tube 28. Also, in the FIG. 3 embodiment two ports 52' are provided in the sloping wall 59' extending between tip 118 and bend 120 formed in head piece 34'. In the upper half of the cylindrical section 122 of head piece 34' a series of four radial ports 50' are provided in cavity wall portion 54'. Each of the longitudinal rows of ports 50' are equally spaced about the circumference of head 34' at 10 mm intervals for example.

FIG. 3 illustrates transport tube 28 in a first position with respect to clamping casing 62 where the clamping casing is positioned in contact or close to contact with rear wall 124 of the head of the dispensing device (e.g., 0 to 50 mm from wall 124). In the second transport tube position casing 62 is positioned preferably in the intermediate area of tube 28 (e.g., 150 to 250 mm from wall 124). The significance of the close to head and further removed from head adjustment in the transport tube of the dispensing device is discussed in greater detail below.

Figure 5:
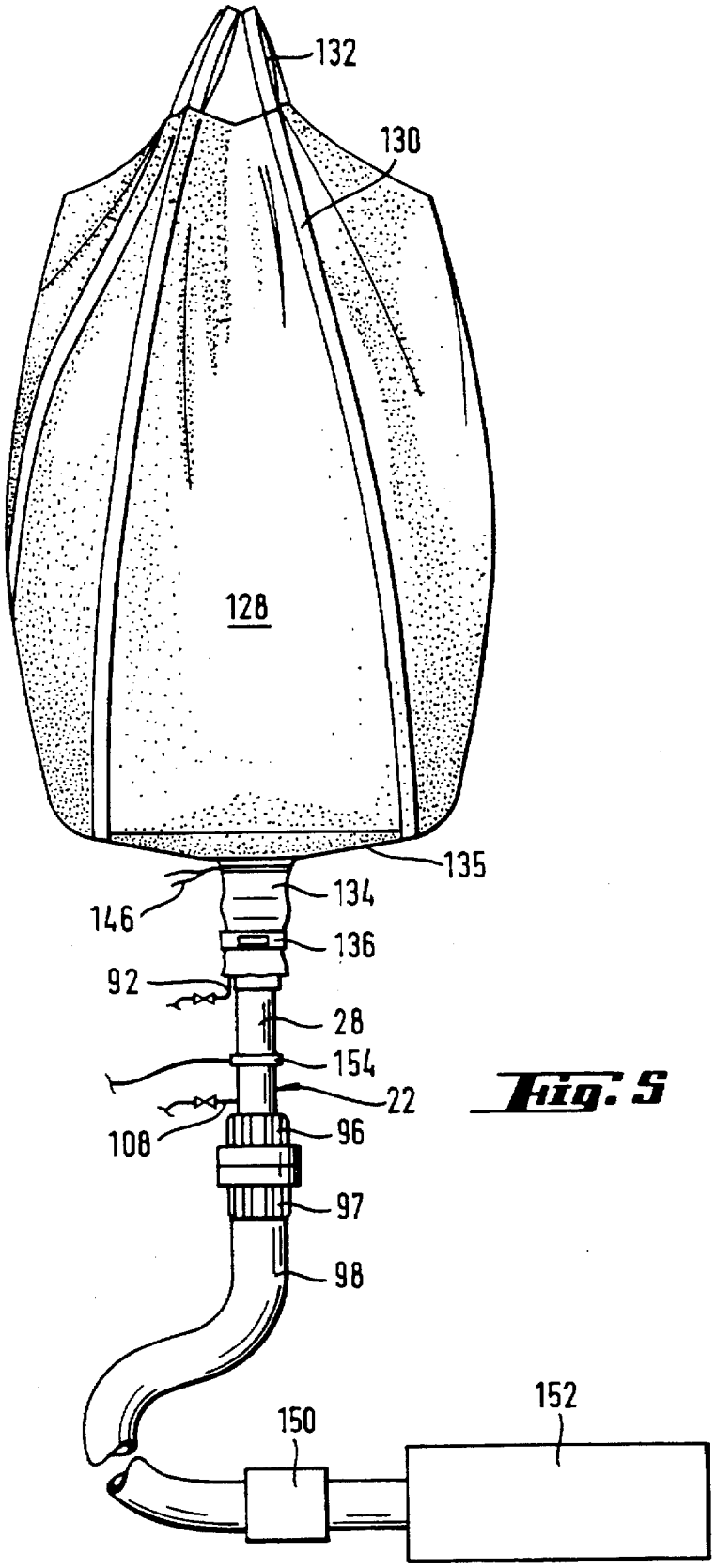
FIG. 5 shows a partially cut-away, front elevational view of a dispensing assembly embodiment of the present invention.

The present invention is particularly suited for use with flexible intermediate bulk containers or FIBCs and FIG. 5 illustrates dispensing device 22 in position with respect to FIBC 128. FIBC 128 is a semi-bulk container with a capacity lying between that of shrink wrapped sacks and of silo vehicles. FIBCs are typically formed of woven plastic-coated bands with sealed, reinforced seams. FIBCs typically have a volume of about $2m^3$ which results in a height of about 5 feet and a circumference designed for receipt on a standard size wood pallet with a two to six inch clearance inward of the pallet's outer periphery. This can be compared with a pallet load of shrink wrapped sacks which typically involves 30 sacks stacked on one pallet versus the one FIBC per pallet ratio.

FIG. 5 illustrates FIBC 128 with sealed seams 130 as well as hanging straps 132 which are secured to the top of container 128 and are attached to a supporting structure such that the container can be suspended off the ground with its flexible outlet tube 134 extending freely downward from a central region of the sloped bottom 135 of container 128. The diameter of outlet tube 134 can be varied to suit the particular discharge needs and is preferably sized so as to be close in diameter to the dispensing device's tube 28 (e.g., within 3 cms of the tube's diameter) or vice versa. Also since the dispensing device of the present invention facilitates a rapid removal of the fine particles, outlet tube 134 can be made smaller than the typical 30 cm in diameter size found in many FIBC's. The typical outlet tube length of 50 cm can be retained, lengthened or made shorter in the FIBC when used with the dispensing device of the present invention. The ability to make the outlet tube's diameter smaller is advantageous from the standpoint of further assurance against dust release from the outlet tube.

FIG. 5 further illustrates dispensing device 22 being fixed in position with respect to outlet tube 134 through use of fixing device 136. Fixing device 136 is preferably a hose clamp, cable binder, bag buckle (with an over center latch for instance), etc. Fixing device 136 can be used alone or in conjunction with inflatable seal 80. Alternatively, inflatable seal 80 and the frictional contact it assumes with respect to the interior of tube may be relied upon alone and without the assistance of fixing device 136.

Figure 8:
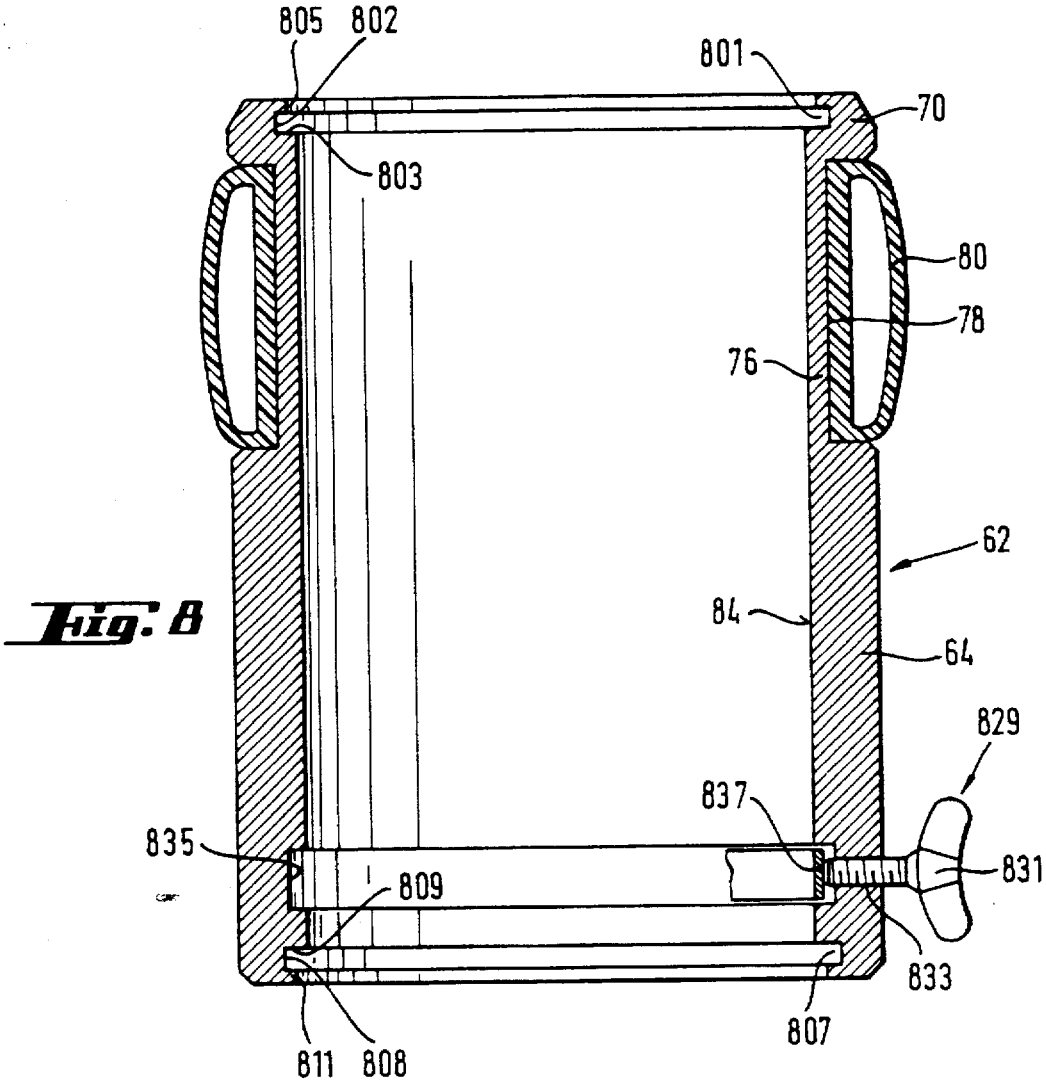
FIG. 8 shows a longitudinal cross-section view of a preferred clamping casing embodiment.

FIG. 8 shows a longitudinal cross-sectional view of a preferred embodiment of clamping casing 62. FIG. 8 also reveals clamping casing 62 as including inflatable member 80 although this preferred embodiment can be one which is free of an inflatable member and thus also free of the recess 78 formed for receiving the inflatable member. FIG. 8 also shows the recess 78 being formed free of the inwardly extending flanges 72, 74 shown in FIG. 2.

As shown in FIG. 8 forward end 70 of clamping casing 62 includes an interior circumferential recess 801 which is defined by exterior wall 802, side wall 803 and inwardly extending flange 805. At the opposite end of clamping casing 62 is a similar arrangement with interior circumferential recess 807 being defined by back wall 808, side wall 809 and flange 811. The forward and rearward circumferential recesses 801 and 807 receive a seal member such as seal member 813 shown in FIG. 8A. The seal members prevent particles from escaping out between the gap which exists between the transport tube and clamping casing. The manner in which seal member 813 is received and retained by recess 801 is shown in FIG. 8B. A mirror image of the seal arrangement would be provided at the opposite end of clamping casing 62. Seal member 813 is preferably formed of a flexible plastic or elastomeric material with a low friction level.

Figure 8A:
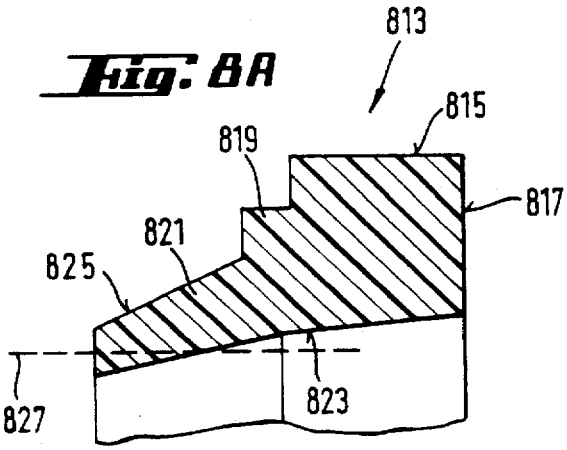
FIG. 8A shows a cut-away view of the sealing member used with the clamping case.
Figure 8B:
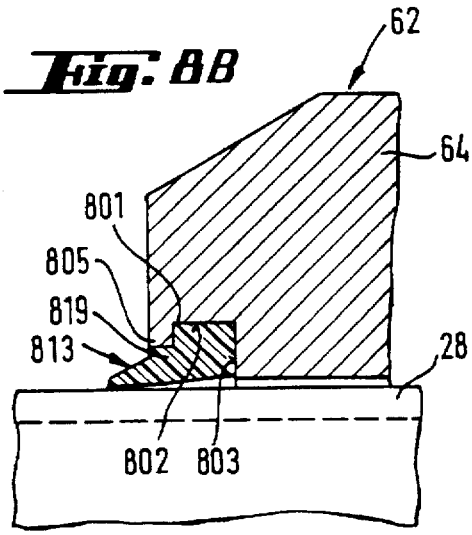
FIG. 8B shows the sealing member in position on the clamping casing.

As particularly shown in FIGS. 8A and 8B, each seal member 813 includes exterior planar surface 815 which contacts wall surface 802 and 808, respectively. Each seal member also includes planar side wall 817 which contacts wall surface 803 and 809, respectively. Outward of planar surface 815 is stepped section 819 which abuts an interior side wall and interior edge wall of a respective one of flanges 805 and 811. Each seal member 813 further includes an inwardly sloping portion 821 defined by sloping surfaces 823 and 825. Sloping portion 821 is designed to extend further inward than the exterior surface of tube 28 as represented by dash line 827 in FIG. 8A. Thus, as shown by FIG. 8B, when seal 813 is in position within clamping casing 62, it is deflected outwardly by tube 28 so as to provide a tight seal. A single seal at either end may be relied upon, although the dual seal arrangement is preferred. Seal 813 also includes stepped shoulder section 819 which is positioned at the base of sloping portion 821 and is designed with a notch 820 which receives flange 805 so as to lock seal 813 in position.

FIG. 8 further shows a preferred embodiment of axial fixing assembly or means 829. As shown on FIG. 8, axial fixing assembly 829 includes one or more thumb screws 831 received within a corresponding threaded bore 833 which radial extends to opposite surfaces of clamping casing 62. Clamping casing 62 further includes circumferential recess 835 within which is positioned circumferential spring plate 837 (partially shown in FIG. 8). The inner end of thumb screw 831 abuts plate 837 and forces it further inward when screw 831 is threaded radially inward. The inward movement of plate 837 results in the axial fixing of clamping casing 62 to transport tube 28 which is received within clamping casing 62. The operator can easily release the fixed arrangement between the clamping casing and transport tube by backing off screw 831 (and hence spring plate 837) whereby the transport tube can be axially shifted and then locked in a different position. Plate 837 can include friction entrancing members such as a soft rubber interior laminate.

In another embodiment of the invention, rather than a continuous exterior surface, circumferential recess 144 (see the dashed line depiction in FIG. 4) is formed in rear section 64 of clamping casing 62 preferably in an intermediate area of rear section 64 positioned between end 126 of clamping casing 62 and the recess for the inflation member. Recess 144 is used in combination with fixing device 136 to securely connect the dispensing device with respect to outlet tube 134 and to help in locating strap placement. Also, since it is beneficial to avoid tearing or otherwise degrading the FIBC such that it can be reused, the edges defining recess 144 can be curved or otherwise made smooth. The earlier described attachments or fixing devices are also of the type that avoids degrading the outlet tube 134 in the event it is decided to reuse the FIBC.

In yet another embodiment of the invention the clamping casing and dispensing device can be formed as an integral or permanently secured arrangement (e.g., an adhesive bond) whereby both the dispensing device and FIBC can be sold as a single unit and used repeatedly or discarded.

Figure 6:
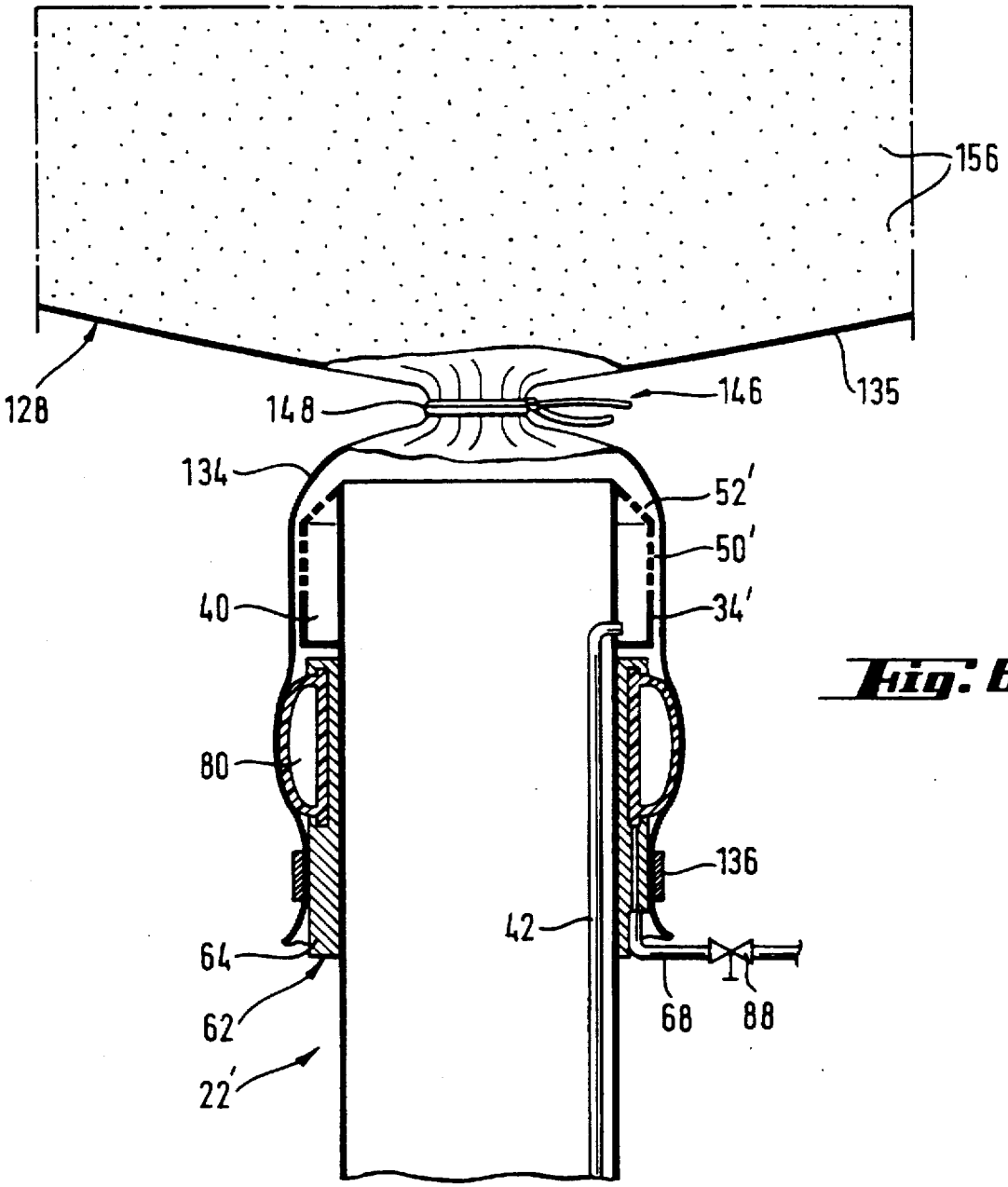
FIG. 6 shows a cross-sectional view of a portion of the assembly shown in FIG. 5 where the dispensing device is sealed and fixed to the outlet tube of the container.
Figure 9:
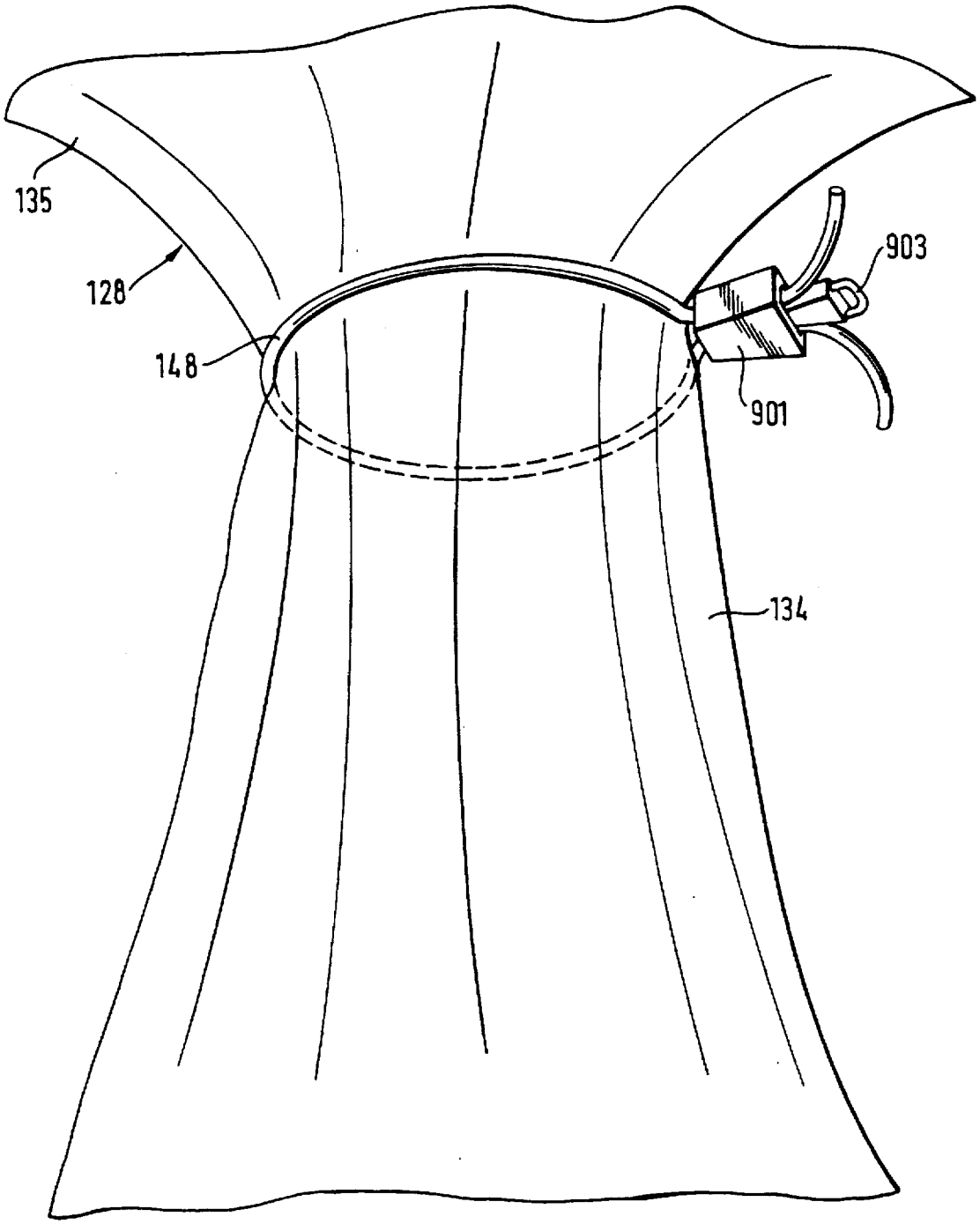
FIG. 9 shows a cut-away view of an alternate embodiment of a release mechanism for precluding flow of material through the outlet tube until release thereof.

FIG. 5 further illustrates release mechanism which in this embodiment is a cord drawing device 146 which provides a disengagement function with respect to outlet tube 134. As will be explained in greater detail below the activation of cord drawing device 146 and opening of the base of outlet tube 134 does not lead to a direct exiting of particles out of outlet tube 134, but releases the particles to the below positioned dispensing device sealed within the interior of outlet tube 134. As shown in FIG. 6, cord drawing device 146 can comprise a rope or cord 148 which is tied in a knot to preclude release of dust particles. Following securement of the dispensing device 22 in outlet tube 134, the knot can be untied to release the fine particles above rope 148. FIG. 9 shows an alternate embodiment wherein clip or clamp 901 is used to maintain rope 148 tightly fixed about outlet tube 134. A spring biased tab 903 or the like is also provided to facilitate locking and unlocking of clip or clamp 901 on rope 148.

FIG. 5 there is also illustrated transport line 98 extending out away from the rear end of dispensing device 22 into connection with transport unit 150 (e.g., a double membrane pump operated by compressed air or to a pneumatic transport or a combination suction source/mixer such as the YSTRAL jet-stream mixer or the YSTRAL-conti TDS mixer of the manufacturer Ystral GmbH of Germany). Downstream of transport unit 150 is positioned downstream unit 152 which, as noted above, can actually be an assembly which functions both as the suction source and mixer, can be a processor assembly for producing a product, or can be an intermediate storage facility either of a larger or smaller volume than that of the FIBC. To help protect against the creation of sparks during the movement of the fine particles, a grounding device can be provided to tube 28 as exemplified by reference number 154. This grounding device can be supplemental with a grounding device in transport line 98. For some kinds of products the FIBC itself has to be made of an anti-static material (electrostatic dissipating material) and has to be grounded while being discharged (e.g., grounding directly from the bag to a ground location or first via a conductive dispensing device to a ground location).

The use and method of operation of the present invention is now explained with reference to FIGS. 6 and 7. FIG. 6 illustrates fine particles 156 positioned in sloped bottom 135 of FIBC 128 and precluded from exiting due to cord device 146. At the time of release, the binding cord 148 or other type of binding member is disengaged to open outlet tube 134. FIG. 6 also illustrates dispensing device 22' (or 22) positioned in a first position wherein it is positioned within outlet conduit 134 with head piece 34' just below (e.g., within 10 cm and preferably within 4 cm) cord drawing device 146 at the base of the outlet nozzle. Clamping casing 62 of dispensing device 22' is releasably fixed to tube 28 in the first position by activating or positioning an axial fixing assembly such as one of those described above (e.g., threading a thumb screw inwardly to pinch a spring plate against the tube). FIG. 6 also shows dispensing device 22' fixed and sealed in position with respect to outlet tube 134 by way of inflated seal 80 and fixing device 136 which in this instance is a strap with an elastomeric main body or interior protective liner as well as preferably an over center latch (not shown) extending about clamping casing 62 and the container material therebetween. The fixing device 136 can also be the inflatable fixing and sealing member alone and without an exterior strap member.

Figure 7:
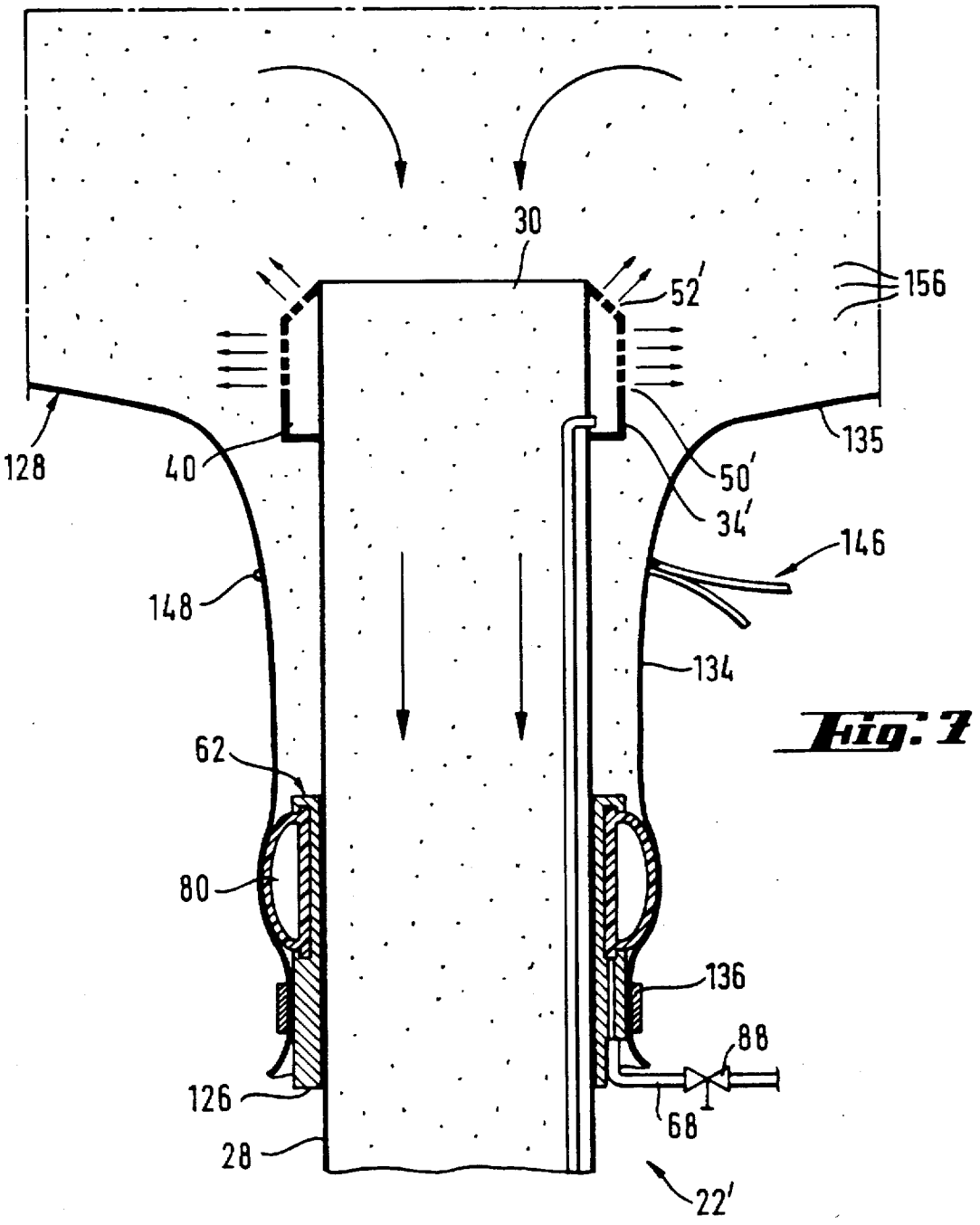
FIG. 7 shows a similar view to that of FIG. 6 only with the transport tube shifted into a second position following a release of the locking means provided at the base of the container's outlet tube.

FIG. 7 shows dispensing device 22' in a second position which is assumed subsequent to establishing the first position. Before the tube is moved between the first and second positions, cord drawing device 146 is activated to release the area blocked by cord. Then, tube 28 with its head 34' is shifted with respect to clamping casing 62 which remains essentially stationary with respect to the FIBC. This shifting of tube 28 can be achieved by having an operator lift up on the lower end of tube 28 (either while air is being injected through ports 50' and 52' or prior to introducing pressurized air to cavity 40). In the second position air is ejected out of the ports to place particles 156 in a fluidized state above opening 30. Once this fluidized state is reached or during the reaching of this state, particles are drawn through opening 30, through tube 20 and through transport line 98 under the suction action produced by unit 150 and eventually to downstream unit 152. The suction rate and fluidizing flow rate depend on the type of material being dispensed and can be adjusted to meet the desired dispensing rate for the particular material being dispensed.

When essentially all of the particles have been removed from the FBIC, dispensing device 22' is shifted back into the first position while air or gas is still being injected into the FBIC and the vacuum force is still being applied. In this way any particles that may have fallen into position between tube 28 and outlet tube 134 and above seal 80 (if used) or fixing device 136 if seal 80 is not used are placed in a fluidized state and drawn out through tube 28. This helps avoid contamination of the surrounding environment when the FBIC is detached from the dispensing device and folded up for later reuse or for receipt within a trash receptacle. Accordingly the present invention presents an apparatus and method that assures an excellent freedom from dust contamination, as well as fast and virtually complete removal of particle material.

Figure 12:
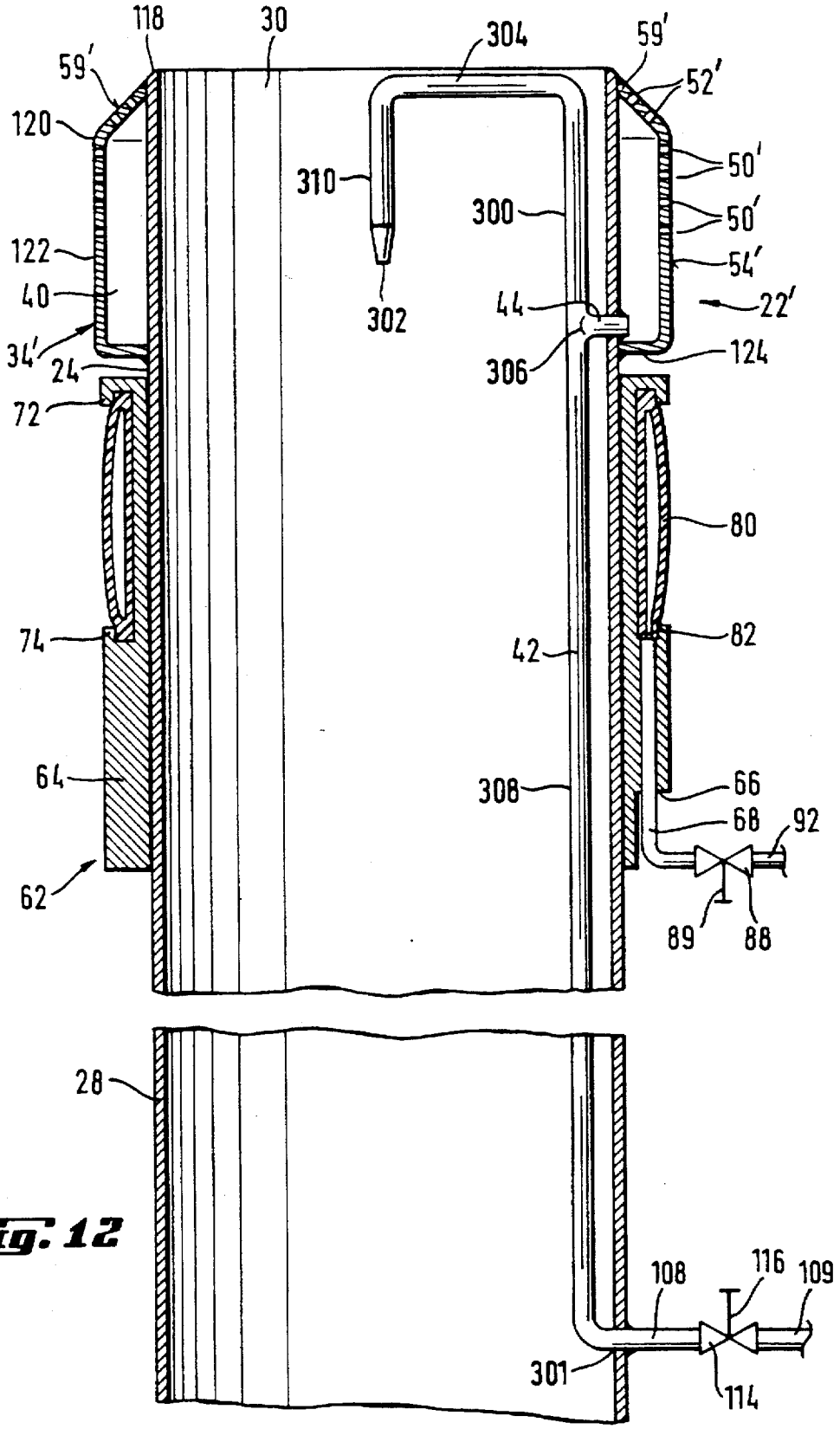
FIG. 12 shows an alternate embodiment of the present invention which is similar to the embodiment shown in FIG. 3 except for an added central axis gas injection conduit branch.

FIG. 12 shows an alternate embodiment of the dispensing assembly 22' of the present invention. As the embodiment of FIG. 12 is similar in many respects to the dispensing device 22' embodiment of FIG. 3, only the differences will be emphasized. As shown in FIG. 12, conduit 42 extends up from its connection 100 with tube 28 and into cavity 40 of headpiece 34' as in the earlier embodiment. However, conduit 42 opens into gas injection branch 300 which is designed so as to direct injected gas, such as air, away from the inlet opening 30 and toward the discharge end 33 of tube 28. Preferably, exhaust opening 302 is coaxial with the central axis of tube 28. Also, it is preferable to have gas injection branch 300 in the shape of a hook with its curved portion 304 commensurate with the upper rim of headpiece 34' and its exhaust opening 302 at a location essentially commensurate with branch 306 of conduit 42 opening into cavity 40 or axially between branch 306 and the rim defining inlet opening 30.

As shown in FIG. 12, branches 300 and 306 of conduit 42 can be arranged transversely with branch 300 lined up with main branch 308 extending parallel with the central axis of tube 28 as does outlet section 310 of branch 300. Alternate arrangements are also possible such as, for example, a Y-branch arrangement or a dual hook-shaped branch arrangement.

As in U.S. Pat. No. 5,458,264 to Schaffer et al., which patent is incorporated herein by reference, the coaxial gas stream facilitates the removal of particles through the dispensing nozzle. In the embodiment of FIG. 12, injection branch 300 works in unison with the injected gas emanating from headpiece 34' to provide an efficient, coordinated manner for rapidly dispensing material within the container. Through branch size differentials, branch configuration alterations and/or blocking valves (not shown), the amount and velocity of the injected gas out of ports 50' and 52' and exhaust opening 302 can be varied to suit the particular circumstances.

Figure 13:
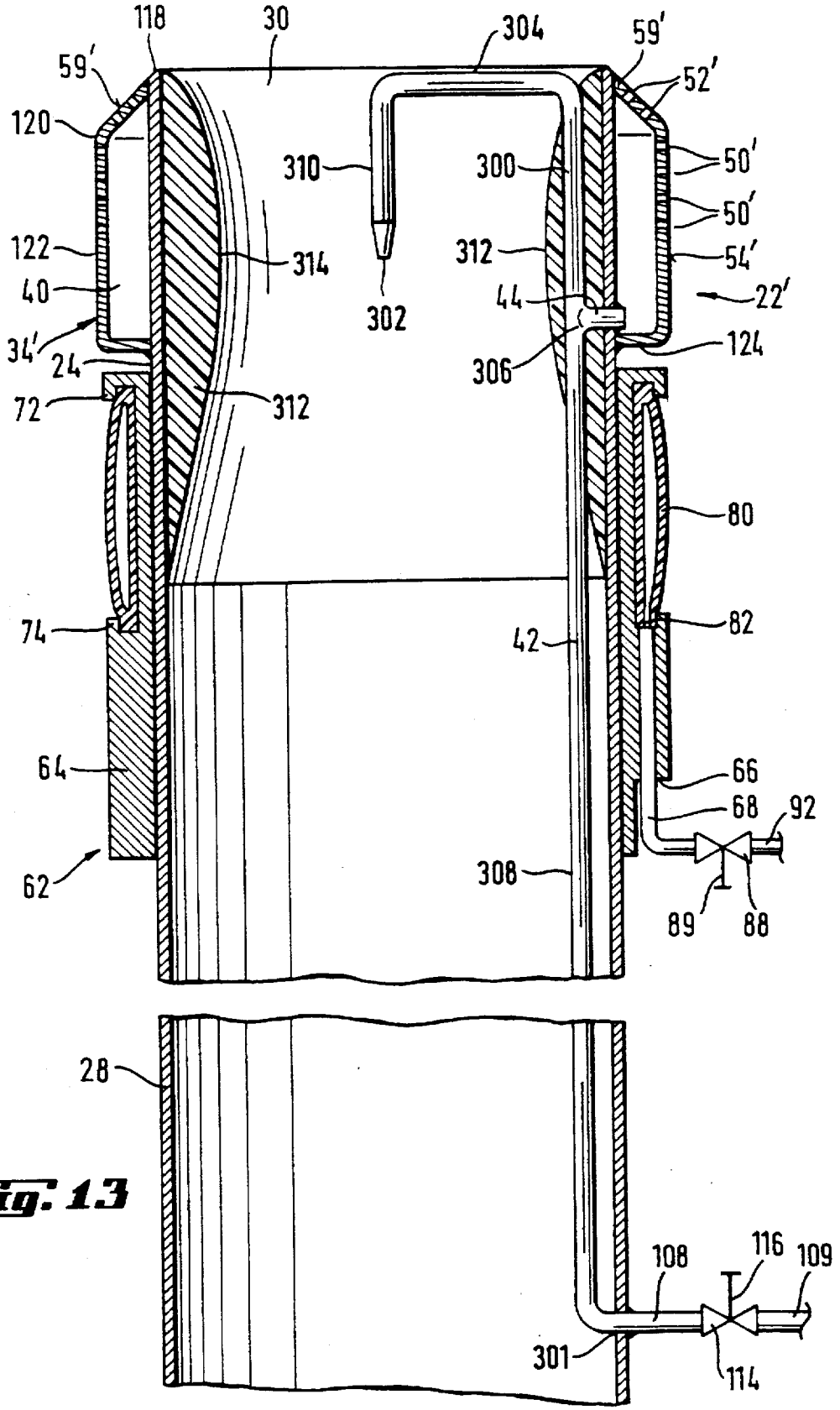
FIG. 13 shows another alternate embodiment of the invention similar to that of FIG. 12 except for an added constricting member.

FIG. 13 shows a view of an additional embodiment of dispensing device 22' of the present invention. The embodiment of FIG. 13 is similar to that in FIG. 12 except for the added insert 312 which is preferably formed of a polymeric (e.g., polypropylene) and adhered or otherwise affixed to the interior surface of tube 28. Insert 312 has a cylindrical exterior and a rising and lowering interior wall which forms a venturi configuration.

Insert 312 can either be preformed for receiving portions of branches 300 and 306 or actually molded around conduit 42. Insert 312 can also be fixed in position solely by conduit 42 with the latter joined to tube 42 or in combination with adhesive or some other fastening means. Alternatively, insert 312 can be utilized to fix branch 306 in the proper position with respect to headpiece 34'. As also shown in FIG. 13, exhaust outlet 302 of branch 300 is preferably positioned axially within tube 28 at a location that corresponds with the most constricted portion 314 of insert 312.

The venturi shape of insert 312 helps increase the stream velocity of particles being dispensed through conduit. Under this venturi effect, the resulting lower pressure at the upper opening helps further draw in material to the inlet opening 30 so as to improve dispensing performance.

Figure 14:
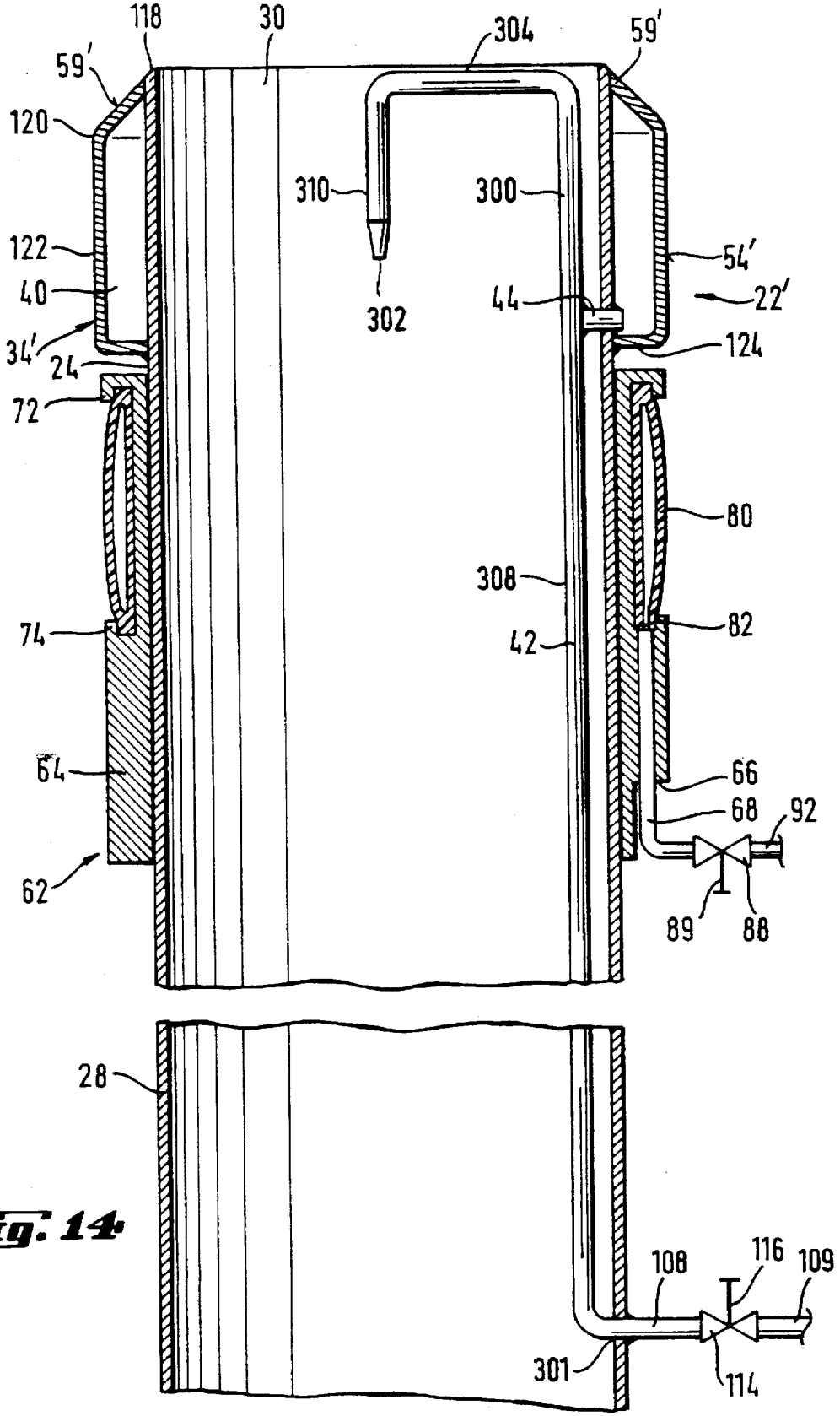
FIG. 14 shows another alternate embodiment of the invention which is similar to that shown in FIG. 12 except that the nozzle head does not include any fluidization ports and gas injection is limited to the central axis injection conduit.
Figure 15:
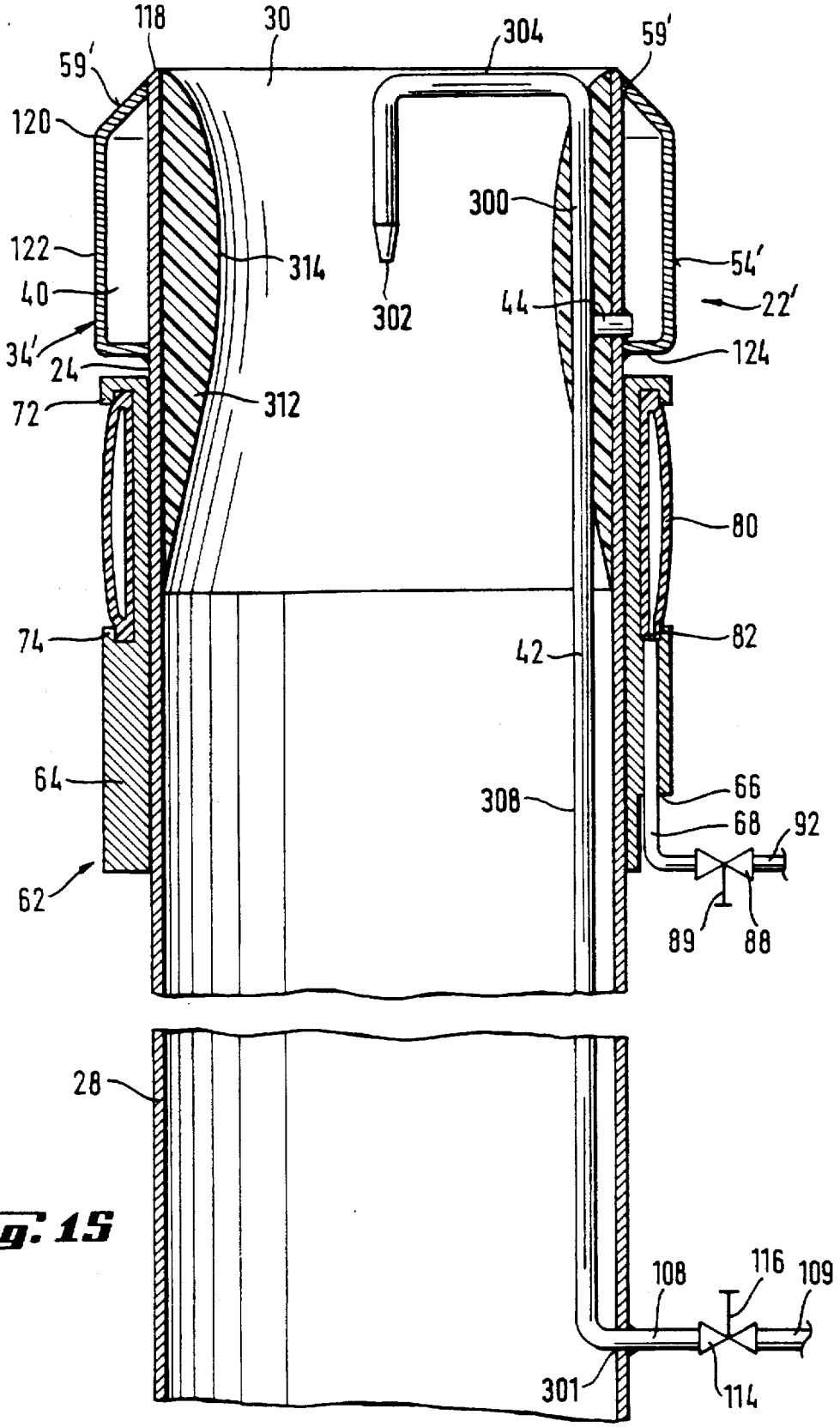
FIG. 15 shows yet another embodiment of the present invention which is the same as FIG. 14 except for an added venturi constriction.

FIGS. 14 and 15 illustrate two further embodiments of the present invention which correspond to FIGS. 12 and 13, respectively, except for the variations described below. In each of the embodiments of FIGS. 14 and 15, the gas exiting exhaust opening 302 represents the sole source of injected gas as there is lacking any ports 50' or 52' in headpiece 34' (or a headpiece at all) and branch 306 actually represents a solid or closed support peg rather than a gas conduit branch.

Further variations and modifications will be apparent to those skilled in the art and are intended to be encompassed by the claims appended hereto.

What is claimed is:

1. A dispensing assembly for dispensing fine particles from a container comprising:

a dispensing device which includes;

at a transport tube having a product inlet opening at a forward region and a product discharge opening at a rearward region;

a head piece positioned at the forward region of said transport tube, said head piece including a chamber housing defining a gas receipt chamber, and a plurality of gas outlet ports formed in said chamber housing;

a gas feed conduit in communication with the gas receipt chamber in said head piece;

a clamping casing which extends about said tube, and said transport tube being axially adjustable with respect to said clamping casing between a first position and a second position with said first position placing said clamping casing closer to said head piece than said second position, and a fixing device which is adapted to fix a portion of the container to said clamping casing while said casing is in or moved between said first position and said second position.

2. A dispensing assembly as recited in claim 1, wherein the chamber housing extends completely about a circumference of said tube and includes an axial wall portion and an oblique wall portion, and said gas outlet ports comprise a plurality of radial ports in said axial wall portion that are spaced circumferentially about said head piece and a plurality of oblique ports in said oblique wall portion spaced about the circumference of said head piece.

3. A dispensing assembly as recited in claim 1 wherein said clamping casing includes axial position fixing means for releasably retaining said transport tube such that said tube can be shifted to and fixed in one of said first and second positions.

4. A dispensing assembly as recited in claim 1 wherein the gas feed conduit of said dispensing device extends along an interior surface of said transport tube and opens into said gas receipt chamber.

5. A dispensing assembly as recited in claim 4 wherein said gas feed conduit extends internally within said transport tube for an axial length which exceeds a maximum axial length said transport tube shifts with respect to said clamping casing.

6. A dispensing assembly as recited in claim 5 wherein said gas feed conduit has a forward end which extends radially and opens into said chamber housing in a rearward half region between a forward wall and a rearward wall defining a forward end and a rearward end of said gas receiving chamber.

7. A dispensing assembly as recited in claim 1 wherein said clamping casing includes a rearward section and a forward section, said forward section having a circumferential recess formed therein, and said dispensing device further comprising an inflatable member received within said circumferential recess.

8. A dispensing assembly as recited in claim 7 wherein said forward section includes a forward flange section extending rearwardly so as to partially cover said circumferential recess and a rearward flange section extending forwardly so as to partially cover said circumferential recess while leaving an open area between said forward end rearward flanges through which said inflatable member extends upon inflation, and said inflatable member being nestled within said circumferential recess radially inwardly of said flanges whereby retention of said inflatable member upon inflation is facilitated.

9. A dispensing assembly as recited in claim 7 wherein said dispensing device further comprises an infeed pipe which is supported by said rearward section and provides for introduction of a pressure gas for achieving inflation of said inflatable member.

10. A dispensing assembly as recited in claim 1 wherein said fixing device comprises an inflatable member supported by said clamping casing so as to be radially expandable out away from said clamping casing and into contact with an outlet tube of the container.

11. A dispensing assembly as recited in claim 1 further comprising an axial position fixing assembly which includes at least one fixing member which is radially adjustably supported by said clamping casing such that the transport tube can be fixed in position with respect to said clamping casing by said at least one fixing member.

12. A dispensing assembly as recited in claim 1 wherein said transport tube has a common interior diameter along its axial length and the product inlet opening is formed at a forwardmost end of said transport tube and has a same diameter as said common interior diameter, and said head piece having a forward end assembly commensurate with the product inlet opening in said transport tube.

13. A dispensing assembly as recited in claim 1 wherein said fixing device includes a strap or band like member which fixes the container portion against said clamping casing.

14. A dispensing assembly as recited in claim 1 wherein said fixing device is an inflatable member supported by said clamping casing which is positioned for contact with an interior surface of a portion of the container.

15. A dispensing assembly as recited in claim 1 wherein said clamping casing includes a forward section and a rearward section and said rearward section supporting said fixing device when in position and said forward section supporting an inflatable member, with said fixing device being positioned externally with respect to an outlet tube of the container and said inflatable member being positioned within the outlet tube when the outlet tube is fixed to said rearward section by said fixing device.

16. A dispensing assembly as recited in claim 1 further comprising a transport line and a transport unit, said transport line having an upstream end in communication with an opening at the rearward end of said transport tube and a downstream end in communication with said transport unit, and said transport unit including a suction generating device for drawing product in the container through said transport tube and along said transport line, and said dispensing assembly further comprising a pressurized gas unit for introducing pressurized gas into said gas receiving chamber.

17. A dispensing assembly as recited in claim 1 further comprising a fine particle container having an outlet tube, and said fixing device fixing said outlet tube to said clamping casing.

18. A dispensing assembly as recited in claim 17 wherein said container is a flexible intermediate bulk container having a volume of from 1.5 $m^3$ to 2.5 $m^3$.

19. A dispensing assembly as recited in claim 17 wherein said outlet tube has a diameter which is within 3 cm of an exterior diameter of said clamping casing.

20. A dispensing assembly as recited in claim 1 wherein said clamping casing includes an axial position locking assembly that comprises a radially adjustable member extending through a bore hole formed in said clamping casing, a circumferential recess formed in an interior surface of the clamping casing, and a spring plate positioned within said circumferential recess and adapted to shift internally upon internal shifting of said radially adjustable member.

21. A dispensing assembly as recited in claim 1 further comprising a seal member positioned between said clamping casing and transport tube.

22. A dispensing assembly as recited in claim 21 wherein said clamping member has a circumferential recess and said seal member has a ring shaped main body received within said circumferential recess and a sloping portion which is deflected radially outward by the transport tube received within said clamping casing.

23. A dispensing assembly as recited in claim 22 wherein main body includes a stepped portion and said clamping casing includes an inwardly extending flange which contacts the stepped portion.

24. A dispensing assembly as recited in claim 21 further comprising a second sealing member with one of said sealing members provided at a forward region of said clamping casing and another at a rearward region of said clamping casing.

25. A method for dispensing fine particles from a container with an outlet tube, by way of a dispensing device fixed in position with respect to the outlet tube and having a transport tube with a clamping casing extending about the transport tube, said method comprising:

shifting axially said transport tube with respect to said clamping casing between a first position within said container and a second position within said container whereby a head section of said dispensing device is further removed from an outlet end of said outlet tube in said second position then in said first position;

introducing gas into said container; and drawing product material in said container, which product material has been subjected to the step of introducing gas, through an opening in said dispensing device and out of an exit end of said dispensing device so as to empty said container.

26. A method as recited in claim 25 further comprising inserting the dispensing device into the outlet tube and fixing the clamping casing to the outlet tube, and wherein fixing said dispensing device to said outlet tube includes inflating an inflatable member supported by said clamping casing into contact with said outlet tube.

27. A method as recited in claim 25 further comprising inserting the dispensing device into the outlet tube and fixing the dispensing device to the outlet tube and wherein fixing said dispensing device to said outlet tube includes applying a band or strap like member so as to pinch said outlet tube between said band or strap like member and said clamping casing, and said method further comprising inflating an inflatable member supported by said clamping casing forward of said band or strip like member such that said inflatable member contacts an interior surface of said outlet tube.

28. A method as recited in claim 25 further comprising inserting said dispensing device into said outlet tube, affixing said dispensing device to said outlet tube, releasing a mechanism which prevents product from exiting a main compartment of the container and entering said outlet tube until released, shifting said transport tube to said second position after release of said mechanism such that product is released into said outlet tube, and initiating the drawing of product through the dispensing device following release of said mechanism.

29. A method as recited in claim 25 wherein said step of introducing gas includes injecting air into the fine particles within the container to improve flowability of those products.

30. A method as recited in claim 29 wherein the air is injected while said head section is both in said first and second positions.

31. A method as recited in claim 25 wherein, at a point close to a complete emptying of said container, said transport tube is shifted back to the first position while gas is being ejected from said head section and product is being drawn through said transport tube.

32. A method as recited in claim 25 wherein said step of introducing gas includes injecting gas coaxially through said transport tube in a direction of dispensing particle flow.

33. A method as recited in claim 32 further comprising injecting gas radially outward from the transport tube through a plurality of ports formed in a headpiece of said transport tube.

34. A dispensing device comprising:

a transport tube having a product receiving front inlet opening and a product exiting rear outlet opening;

a head section positioned at a forward region of said transport tube said head section defining a gas receiving chamber, and said head section having a plurality of gas ports which are in communication with said gas receiving chamber;

a clamping casing extending about said transport tube and said transport tube being axially shiftable with respect to said clamping casing between a first position and a second position;

a fixing means which is supported by said clamping casing when in operational position.

35. A dispensing device as recited in claim 34 wherein said fixing means includes an inflatable member supported in a circumferential recess within said clamping casing.

36. A dispensing device as recited in claim 35 wherein said fixing means further includes a band or strap like member which is supported on said clamping casing rearward of said circumferential recess when in operational position.

37. A dispensing device as recited in claim 34 further comprising a pressure gas conduit which extends axially along an interior surface of said transport tube for an axial length greater than an axial shifting length between said first and second positions of said transport tube with respect to said clamping casing.

38. A dispensing assembly for dispensing fine particles from a container comprising:

a product transportation conduit;

a suction source in communication with said product transportation conduit;

a gas injection means for facilitating removal of particles within said container;

a dispensing device which includes a transport tube having a product inlet opening and a product discharge opening, said transport tube being in communication with said product transportation conduit, and said gas injection means being supported by said transport tube, a clamping casing which extends about said transport tube, and said transport tube being axially adjustable with respect to said clamping casing between a first position and a second position within said container, with said first position placing said clamping casing closer to said head piece than said second position, and a fixing device which is adapted to fix a portion of said clamping casing while said casing is shifted between said first position and said second position.

39. A dispensing assembly as recited in claim 38 wherein said gas injection means includes a branch conduit having an exhaust opening coaxially aligned with said transport tube.

40. A dispensing assembly as recited in claim 39 further comprising a headpiece at said inlet opening of said transport tube, and said means for injecting gas including a plurality of circumferentially spaced gas injection ports formed in said headpiece and extending, at least to some extent, radially outward from the central axis of said transport tube.

41. A dispensing assembly as recited in claim 39 further comprising a venturi shaped insert supported in said transport tube and in contact with said branch conduit.

42. A dispensing assembly as recited in claim 38 further comprising a headpiece at said inlet opening of said transport tube, and said means for injecting gas including a plurality of circumferentially spaced gas injection ports formed in said headpiece and extending, at least to some extent, radially outward from the central axis of said transport tube.

* * * * *